US006410163B1

(12) United States Patent
Suzuki et al.

(10) Patent No.: US 6,410,163 B1
(45) Date of Patent: Jun. 25, 2002

(54) HIGH STRENGTH THIN STEEL SHEET, HIGH STRENGTH ALLOYED HOT-DIP ZINC-COATED STEEL SHEET, AND METHOD FOR PRODUCING THEM

(75) Inventors: Yoshitsugu Suzuki; Kazunori Osawa; Chiaki Kato; Yoichi Tobiyama; Kei Sakata, all of Okayama; Osamu Furukimi, Chiba; Akio Shinohara, Okayama, all of (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/555,339

(22) PCT Filed: Aug. 13, 1999

(86) PCT No.: PCT/JP99/04385

§ 371 (c)(1),
(2), (4) Date: May 30, 2000

(87) PCT Pub. No.: WO00/18976

PCT Pub. Date: Apr. 6, 2000

(30) Foreign Application Priority Data

Sep. 29, 1998 (JP) ..... 10-276034
Nov. 20, 1998 (JP) ..... 10-331767

(51) Int. Cl.[7] ..... B32B 15/01; C21D 8/02

(52) U.S. Cl. ..... 428/659; 148/503; 148/504; 148/533; 148/602; 148/603; 148/657; 148/658; 148/337; 427/433; 427/436; 428/939

(58) Field of Search ..... 428/659, 939; 427/433, 436; 148/503, 504, 533, 602, 603, 657, 658, 337; 420/120, 123, 124

(56) References Cited

U.S. PATENT DOCUMENTS 5,433,796 A * 7/1995 Isobe et al. ..... 427/433

FOREIGN PATENT DOCUMENTS

| | | |
|---|---|---|
| EP | 0 657 560 | 6/1995 |
| JP | 55-50455 | 4/1980 |
| JP | 63-449 | 5/1988 |
| JP | 7-9055 | 2/1995 |
| JP | 7-268584 | 10/1995 |
| JP | 10-17936 | 1/1998 |

* cited by examiner

*Primary Examiner*—Robert R. Koehler
(74) *Attorney, Agent, or Firm*—Young & Thompson

(57) ABSTRACT

The present invention provides a high strength thin excellent workability and galvanizability, having a composition comprising from 0.01 to 0.20 wt. % C, up to 1.0 wt. % Si, from 1.0 to 3.0 wt. % Mn, up to 0.10 wt. % P, up to 0.05 wt. % S, up to 0.10 wt. % Al, up to 0.010 wt. % N, up to 1.0 wt. % Cr, from 0.001 to 1.00 wt. % Mo, and the balance Fe and incidental impurities, wherein a band structure comprising a secondary phase has a thickness satisfying the relation $Tb/T \leqq 0.005$ (where, Tb: average thickness of the band structure in the thickness direction of steel sheet; T: steel sheet thickness), and a manufacturing method thereof, and a manufacturing method of a high strength hot-dip galvanized steel sheet or a high strength galvannealed steel sheet applying hot-dip galvanizing or further galvannealing, and giving an excellent workability, a high tensile strength, and excellent galvanizability, coating adhesion and corrosion resistance.

21 Claims, 7 Drawing Sheets

(a)

(b)

(a)

(b)

HIGH STRENGTH THIN STEEL SHEET, HIGH STRENGTH ALLOYED HOT-DIP ZINC-COATED STEEL SHEET, AND METHOD FOR PRODUCING THEM

TECHNICAL FIELD

The present invention relates to a high strength thin steel sheet (substrate for galvanizing) suitable for such uses as an automobile body and a high strength galvannealed steel sheet made from the high strength thin steel sheet, as well as manufacturing methods of the high strength thin steel sheet, the high strength hot-dip galvanized steel sheet and the high strength galvannealed steel sheet.

BACKGROUND ART

From the point of view of achieving a high safety, a smaller weight, a lower fuel/cost ratio, and hence cleaner earth environments, there are increasing applications of high strength steel sheets and high strength hot-dip galvanized steel sheets excellent in corrosion resistance as steel sheets for automobiles.

In order to manufacture high strength hot-dip galvanized steel sheets among others, it is necessary to previously manufacture a material sheet having a good galvanizability, and giving desired strength and workability after passing through a hot-dip galvanizing bath, and after application of a galvannealing treatment.

In order to increase strength of a steel sheet, in general, it is the common practice to add solid solution hardening elements such as P, Mn and Si and precipitation hardening elements such as Ti, Nb and V.

When a steel sheet containing these elements added as described above is treated on a continuous hot-dip galvanizing line (CGL), the steel sheet is subjected to annealing at a temperature of over the Ac1 transformation point, and further, a low cooling rate makes it difficult to obtain a high tensile strength: achievement of a high tensile strength requires addition of alloy elements in large quantities, and this leads to a higher cost.

Addition of alloy elements in large quantities is known to cause serious deterioration of galvanizing property. The quantities of added alloy elements are limited also from the point of view of galvanizability.

Because of the contradictory actions of alloy elements in the substrate steel sheet on strength and galvanizability, it has been very difficult to manufacture a high strength hot-dip galvanized steel sheet excellent in galvanizability on a continuous hot-dip galvanizing line.

In the case of high strength steel sheet, it has further been difficult to manufacture a hot-dip galvanized steel sheet excellent in workability, because of low properties relating to workability such as elongation.

As a high strength steel sheet having a high workability, on the other hand, there has conventionally been proposed a composite (containing residual austenite) mainly comprising martensite with ferrite as the base metal.

This composite structure steel sheet is non-aging at room temperature, has a low yield ratio [:{yield strength (YS)}/{tensile strength (TS)}], and is excellent in workability and hardenability after working.

A known manufacturing method of a composite structure steel sheet is to heat a steel sheet at a temperature within the ($\alpha+\gamma$) region, and then rapid cool the steel sheet by water cooling or gas cooling. It is also known that a higher cooling rate leads to the necessity of a smaller number of necessary alloy elements and a smaller amount of addition.

However, when a conventional composite structure steel sheet is subjected to hot-dip galvanizing at a temperature of about 500° C., or further, to a heating-galvannealing treatment, hard martensite, a targeted secondary phase, does not occur, in addition to the primary phase ferrite, but there are generated soft cementite, pearlite and bainite. This results in a decrease in tensile strength and appearance of an upper yield point, leading to an increase in yield point, or further, an yield elongation.

Temper softening tends to be easily caused according as the quantities of added alloy elements become smaller. Large quantities of these alloy elements causes, on the other hand, a decrease in hot-dip galvanizing property.

After all, hard martensite is not generated during the galvanizing step even in the composite structure steel sheet, but soft cementite, pearlite and bainite are produced. It has therefore been difficult to achieve compatibility between workability brought about by the primary phase ferrite and a high strength based on the secondary phase martensite, and a it satisfactory galvanizability in the conventional art.

In a galvanized steel sheet, on the other hand, the galvanized steel sheet is required to be excellent in coating adhesion so as to eliminate the necessity to prevent peeling of the galvanizing layer upon press working and maintain a die.

In order to increase strength of a steel sheet, in general, it is the common practice to add solid solution hardening elements (easily oxidizable elements) such as Mn as described above. These elements however become oxides during reduction-annealing before galvanizing, are concentrated on the steel sheet surface, and reduce wettability by the molten zinc resulting in production of non-galvanized defects on the steel sheet surface in which the galvanizing layer hardly adheres to the steel sheet surface.

The cause is as follows. A recrystallization annealing atmosphere is a reducing atmosphere for Fe, which does not allow production of Fe oxides, but is an oxidizing atmosphere for easily oxidized elements such as Mn. These elements are concentrated on the steel sheet surface, form an oxide film, and thus reduce the contact area between the molten zinc and the steel sheet.

As a manufacturing method of a high strength hot-dip galvanized steel sheet, a method of regulating the cooling rate during annealing upon galvanizing is disclosed in Japanese Unexamined Patent Publication No. 55-50455. The disclosed method contains no description about a method for improving galvanizability. Particularly, when the Mn content in the material steel sheet is over 1%, it is difficult to prevent non-galvanized defects, and the method teaches nothing about a method for improving coating adhesion.

Under the current actual circumstances, therefore, the high strength steel sheet excellent in workability attraction as a high strength material for automobile lacks actual means to be applied as a surface-treated steel sheet excellent also in coating adhesion, though not excellent in workability, in the form of a hot-dip galvanized steel sheet.

Japanese Examined Patent Publication No. 7-9055 discloses a method of applying galvanizing to a steel sheet pickled after annealing as a method for improving the galvannealing rate of a P-added steel. This method has however an object to improve the galvannealing rate, not to prevent non-galvanized defects.

The above-mentioned method teaches nothing about the dew point, the hydrogen concentration and temperature of atmosphere gas upon annealing applied immediately prior to galvanizing. Non-galvanized defects are considered to occur more frequently for certain combinations of the kind of steel and the annealing atmosphere.

Japanese Unexamined Patent Publication No. 7-268584 discloses a method of conducting secondary annealing at a temperature determined in response to the P content in steel. This is however based on a technical idea that the temperature region for preventing brittleness of a steel sheet is dependent upon the P content in steel, not a disclosure of a temperature for improving galvanizability.

The present invention has an object to solve the aforementioned problems involved in the conventional art, and to provide a high strength thin steel sheet serving as a substrate for galvanizing which is excellent in workability and strength even after hot-dip galvanizing or further a galvannealing treatment, and gives an excellent galvanizability as well as an excellent corrosion resistance, a galvannealed steel sheet, made of this high strength thin steel sheet excellent in workability, coating adhesion and corrosion resistance, and manufacturing methods thereof.

More specifically, an object of the present invention is to provide a high strength thin steel sheet excellent in workability which satisfies conditions including a yield ratio of up to 70% and a TS×El value of at least 16,000 MPa. %, and permits prevention of occurrence of non-galvanized defects, a high strength galvannealed steel sheet made of the above high strength thin steel sheet, excellent in workability, coating adhesion and corrosion resistance, as well as manufacturing methods of such high strength thin steel sheet, high-strength hot-dip galvanized steel sheet and high strength galvannealed steel sheet.

DISCLOSURE OF INVENTION

As a result of extensive studies carried out to solve these problems, the present inventors obtained the following findings (1) to (4):

(1) Dispersion of Band Structures in Steel Sheet

A thin steel sheet in which a high workability and a high tensile strength are simultaneously achieved, with a satisfactory galvanizability, is available, from the point of view of improving mechanical properties, by using a steel sheet having a prescribed chemical composition and heating the steel sheet to a temperature of at least a prescribed level to cause dispersion of a band structure particularly, comprising a secondary phase (comprising mainly cementite, pearlite and bainite and only partially martensite and residual austenite) to a prescribed extent in the steel sheet.

(2) Two-stage Heating-pickling

A high strength hot-dip galvanized steel sheet, which permits prevention of non-galvanized defects, excellent in workability, coating adhesion and corrosion resistance is obtained, from the point of view of improving galvanizability, by using a steel sheet having a prescribed chemical composition, heating the steel sheet to a temperature of at least a prescribed level in an annealing furnace, then after cooling, removing a concentrated layer of steel constituents on the steel sheet surface, then annealing again the steel sheet at a prescribed heating-reduction temperature in a prescribed reducing atmosphere on a continuous hot-dip galvanizing line, and then, subjecting the steel sheet to hot-dip galvanizing.

In other words, an important point for ensuring a high galvanizability in the method of reduction-annealing a once annealed steel sheet is the atmosphere used upon reduction-annealing.

An oxide film poor in wettability with the molten zinc impairs galvanizability of the steel sheet immediately after annealing unless the atmosphere sufficiently reduces P-based pickling residues produced on the steel sheet surface upon pickling the once annealed steel sheet. In the manufacturing method of a high strength hot-dip galvanized steel sheet of the present invention, the once annealed steel sheet is annealed again at a prescribed heating-reduction temperature in a prescribed reducing atmosphere, and the subjected to hot-dip galvanizing.

(3) One-stage Heating

As a result of further studies, the present inventors obtained the following findings. Satisfactory galvanizability, workability and coating adhesion can be achieved through one-stage heating by subjecting the steel sheet to hot-dip galvanizing after heating the steel sheet at an appropriate heating temperature in an appropriate atmosphere gas.

(4) Galvannealing Treatment

A high strength galvannealed steel sheet excellent both in coating adhesion after galvannealing and corrosion resistance is available by galvannealing the hot-dip galvanized steel sheet obtained in any of (1) to (3) above preferably under conditions satisfying a prescribed galvannealing temperature.

The following aspects of the invention and preferred embodiments of these aspects of the invention (1) to (39) were completed on the basis of the aforementioned findings (1) to (4).

(1) A high strength thin steel sheet excellent in workability and galvanizability, having a composition comprising: C: from 0.01 to 0.20 wt. %, Si: up to 1.0 wt. %, Mn: from 1.0 to 3.0 wt. %, P: up to 0.10 wt. %, S: up to 0.05 wt. %, Al: up to 0.10 wt. %, N: up to 0.010 wt. %, Cr: up to 1.0 wt. %, Mo: from 0.001 to 1.00 wt. %, and the balance Fe and incidental impurities, wherein a band structure comprising a secondary phase has a thickness satisfying the relation $Tb/TS \leqq 0.005$ (where, Tb: average thickness of the band structure in the thickness direction of steel sheet; T: steel sheet thickness).

(2) A high strength thin steel sheet excellent in workability and galvanizability according to (1) above, wherein the high strength thin steel sheet further contains one or more selected from the group consisting of from 0.001 to 1.0 wt. % Nb, from 0.001 to 1.0 wt. % Ti, and from 0.001 to 1.0 wt. % V.

(3) A manufacturing method of a high strength thin steel sheet excellent in workability and galvanizability, wherein the thickness of the band structure comprising a secondary phase is adjusted within a range of $Tb/T \leqq 0.005$ (where, Tb: average thickness of the band structure in the thickness direction of steel sheet, and T: steel sheet thickness) by hot-rolling a slab having a composition comprising: C: from 0.01 to 0.20 wt. %, Si: up to 1.0 wt. %, Mn: from 1.0 to 3.0 wt. %, P: up to 0.10 wt. %, S: up to 0.05 wt. %, Al: up to 0.10 wt. %, N: up to 0.010 wt. %, Cr: up to 1.0 wt. %, Mo: from 0.001 to 1.00 wt. %, and the balance Fe and incidental impurities, coiling the hot-rolled steel sheet at a temperature of up to 750° C., and then, after heating the steel sheet to a temperature of at least 750° C., cooling the same.

(4) A manufacturing method of a high strength thin steel sheet excellent in workability and galvanizability according to (3) above, wherein the thickness of the band structure comprising a secondary phase is adjusted within a range of $Tb/T \leqq 0.005$ (where, Tb: average thickness of the band structure in the thickness direction of steel sheet, and T: steel sheet thickness) by coiling the hot-rolled steel sheet at a temperature of up to 750° C., then cold-rolling the steel sheet, and then, after heating to a temperature of at least 750° C., cooling the same.

(5) A manufacturing method of a high strength thin steel sheet excellent in workability and galvanizability according to (3) or (4) above, comprising the step of, after heating the steel sheet to a temperature of at least 750° C., applying hot-dip galvanizing in the middle of cooling, or, after application of hot-dip galvanizing subjecting the steel sheet to a heating-galvannealing treatment.

(6) A manufacturing method of a high strength thin steel sheet excellent in workability and galvanizability according to (3) or (4) above, comprising the steps of adjusting the thickness of the band structure comprising a secondary phase within a range of $Tb/T \leqq 0.005$ (where, Tb: average thickness of the band structure in the thickness direction of steel sheet, and T: steel sheet thickness), then after heating the steel sheet to a temperature of at least 750° C. and cooling the same, further heating the same to a temperature within a range of from 700 to 850° C., and in the middle of subsequent cooling, subjecting the steel sheet to hot-dip galvanizing, or further to a galvannealing treatment after hot-dip galvanizing.

(7) A manufacturing method of a high strength thin steel sheet excellent in workability and galvanizability according to (5) or (6) above, wherein the coating weight of a hot-dip galvanizing layer, as represented by the coating weight per side of the steel sheet is within a range of from 20 to 120 $g/m^2$.

(8) A manufacturing method of a high strength thin steel sheet excellent in workability and galvanizability according to any one of (5) to (7) above, wherein the coating ;weight of a galvannealed steel sheet after prescribed galvannealing heating treatment, as represented by the coating weight per side of the steel sheet is within a range of from 20 to 120 $g/m^2$.

(9) A manufacturing method of a high strength thin steel sheet excellent in workability and galvanizability according to any one of (3) to (8) above, wherein the slab further contains one or more selected from the group consisting of up to 1.0 wt. % Nb, up to 1.0 wt. % Ti and up to 1.0 wt. %/V

(10) A manufacturing method of a high strength thin steel sheet excellent in workability and galvanizability according to any one of (3) to (8) above, wherein the slab further contains one or more selected from the group consisting of from 0.001 to 1.0 wt. % Nb, from 0.001 to 1.0 wt. % Ti and from 0.001 to 1.0 wt. % V.

(11) A manufacturing method of a high strength hot-dip galvanized steel sheet excellent in workability and coating adhesion according to (3) above, comprising the steps of, after coiling the steel sheet at a temperature of up to 750° C., pickling the same, heating the steel sheet to a temperature of at least 750° C., or preferably, within a range of from 750° C. to 1,000° C., or more preferably, from 800° C. to 1,000° C. in an annealing furnace, removing the concentrated layer of steel constituents on the steel sheet surface by pickling the same after cooling, then, conducting heating-reduction under reducing conditions of P-based oxides remaining as pickling residues on the steel sheet surface, and subjecting the steel sheet to hot-dip galvanizing.

(12) A manufacturing method of a high strength hot-dip galvanized steel sheet excellent in workability and coating adhesion according to (3) above, comprising the steps of, after coiling the steel sheet at a temperature of up to 750° C., pickling the same, then, after cold-rolling the same, heating the steel sheet to a temperature of at least 750° C., or preferably, within a range of from 750° C. to 1,000° C., or more preferably, from 800° C. to 1,000° C. in an annealing furnace, cooling the same, removing the concentrated layer of steel constituents on the steel sheet surface by pickling the same, then, conducting heating-reduction under reducing conditions of P-based oxides remaining as pickling residues on the steel sheet surface, and subjecting the steel sheet to hot-dip galvanizing.

(13) A manufacturing method of high strength hot-dip galvanized steel sheet excellent in workability and coating adhesion according to (3) above, comprising the steps of, after coiling the steel sheet at a temperature of up 750° C., pickling the same, then heating the steel sheet to a temperature of at least 750° C., or preferably, within a range of from 750° C. to 1,000° C., or more preferably, from 800° C. to 1,000° C. in annealing furnace, cooling the same, removing the concentrated layer of steel constituents on the steel sheet surface through pickling, then after heating-reducing steel sheet under conditions including a dew point of an atmosphere gas within a range −50° C. to 0° C. and a hydrogen concentration of the atmosphere gas within a range of from 1 to 100 vol. %, subjecting the steel sheet to hot-dip galvanizing.

(14) A manufacturing method of a high strength hot-dip galvanized steel sheet excellent in workability and coating adhesion according to (3) above, comprising the steps of, after coiling the steel sheet at a temperature of up to 750° C., pickling the same, then cold-rolling the steel sheet, heating the same to a temperature of at least 750° C., or preferably, within a range of from 750° C. to 1,000° C., or more preferably, from 800° C. to 1,000° C. in an annealing furnace, then after cooling the same, removing the concentrated layer of steel constituents on the steel sheet surface through pickling, heating-reducing the steel sheet under conditions including a dew point of an atmosphere gas within a range of from −50° C. to 0° C. and hydrogen concentration in the atmosphere gas within a range of from 1 to 100 vol. %, and then, subjecting the steel sheet to hot-dip galvanizing.

(15) A manufacturing method of a high strength hot-dip galvanized steel sheet excellent in workability and coating adhesion according to (3) above, comprising the steps of, after coiling the steel sheet at a temperature of up to 750° C., pickling the same, then heating the steel sheet to a temperature of at least 750° C., or preferably, within a range of from 750° C. to 1,000° C., or more preferably, from 800° C. to 1,000° C. in an annealing furnace, then after cooling the same, removing the concentrated layer of steel constituents on the steel sheet surface through pickling, then heating-reducing the steel sheet under conditions in which the heating-reduction temperature: $t_1$ (° C.) satisfies the following equation (1) relative to the P content in steel: P (wt. %), and then subjecting the steel sheet to hot-dip galvanizing:

$$0.95 \leqq \{[P(\text{wt. }\%)+(2/3)]\times 1100\}/\{t_1(^\circ\text{ C.})\} \leqq 1.1 \quad (1)$$

(16) A manufacturing method of a high strength hot-dip galvanized steel sheet excellent in workability and coating adhesion according to (3) above, comprising the steps of, after coiling the steel sheet at a temperature of up to 750° C., pickling the same, then cold-rolling the steel sheet, heating the same to a temperature of at least 750° C., or preferably, within a range of from 750° C., to 1,000° C. or more preferably, from 800° C. to 1,000° C. in an annealing furnace, then after cooling the same, removing the concentrated layer of steel constituents on the steel sheet surface through pickling, then heating-reducing the steel sheet under conditions in which the heating-reduction temperature: $t_1$ (° C.) satisfies the following equation (1) relative to the P content in steel: P (wt. %), and then subjecting the steel sheet to hot-dip galvanizing:

$$0.95 \leqq \{[P(\text{wt. }\%)+(2/3)]\times 1100\}/\{t_1(^\circ\text{ C.})\} \leqq 1.1 \quad (1)$$

(17) A manufacturing method of a high strength hot-dip galvanized steel sheet excellent in workability and coating adhesion according to (3) above, comprising the steps of, after coiling the steel sheet at a temperature of up to 750° C., pickling the same, then heating the steel sheet to a temperature of at least 750° C., or preferably, within a range of from 750° C. to 1,000° C., or more preferably, from 800° C. to 1,000° C. in a annealing furnace, then after cooling the same, removing the concentrated layer of steel constituents on the steel sheet surface through pickling, then heating-reducing the steel sheet under conditions in which a dew point of the atmosphere gas within a range of from −50° C. to 0° C., a hydrogen concentration in the atmosphere gas within a range of from 1 to 100 vol. % and the heating-reduction temperature:$t_1$ (° C.) satisfying the following equation (1) relative to the P content in steel: P (wt. %), and subjecting the steel sheet to hot-dip galvanizing:

$$0.9 \leqq \{[P(\text{wt. }\%)+(2/3)]\times 1100\}/\{t_1(^\circ\text{ C.})\} \leqq 1.1 \quad (1)$$

(18) A manufacturing method of a high strength hot-dip galvanized steel sheet excellent in workability and coating adhesion according to (3) above, comprising the steps of, after coiling the steel sheet at a temperature of up to 750° C., pickling the same, then cold-rolling the steel sheet, heating the same to a temperature of at least 750° C., or preferably, within a range of from 750° C. to 1,000° C., or more preferably, from 800° C. to 1,000° C. in an annealing furnace, then after cooling the same, removing the concentrated layer of steel constituents on the steel sheet surface through pickling, then heating-reducing the steel sheet under conditions in which a dew point of the atmosphere gas within a range of from −5° C. to 0° C., a hydrogen concentration in the atmosphere gas within a range of from 1 to 100 vol. % and the heating-reduction temperature: $t_1$ (° C.) satisfying the following equation (1) relative to the P content in steel: P (wt. %), and subjecting the steel sheet to hot-dip galvanizing:

$$0.9 \leqq \{[P(\text{wt. }\%)+(2/3)]\times 1100\}/\{t_1(^\circ\text{ C.})\} \leqq 1.1 \quad (1)$$

(19) A manufacturing method of a high strength hot-dip galvanized steel sheet excellent in workability and coating adhesion according to any one of (11) to (18) above, comprising the steps of heating the steel sheet at a temperature of at least 750° C., preferably within a range of from 750° C. to 1,000° C., or more preferably, from 800° C. to 1,000° C., then after cooling the same, applying thereto a pickling method comprising the step of pickling the steel sheet in a pickling liquid having a pH≦1, and a liquid temperature with a range of from 40 to 90° C. for a period within a range of from 1 to 20 seconds.

(20) A manufacturing method of a high strength hot-dip galvanized steel sheet excellent in workability and coating adhesion according to any one of (11) to (19) above, comprising the step of heating the steel sheet to a temperature of at least 750° C., or preferably within a range of from 750° C. to 1,000° C., or more preferably, from 800° C. to 1,000° C. in an annealing furnace, wherein the pickling liquid after cooling is a hydro chloric acid solution having an HCl concentration within a range of from 1 to 10 wt. %.

(21) A manufacturing method of a high strength hot-dip galvanized steel sheet excellent in workability and coating adhesion according to (3) above, comprising the steps of, after coiling the steel sheet at a temperature of up to 750° C., pickling the same, then heating the same at a heating temperature: T within a range of from 750° C. to 1,000 C. and satisfying the following equation (2) in an atmosphere gas having a dew point: t of an atmosphere gas satisfying the following equation (3) and a hydrogen concentration within a range of from 1 to 100 vol. %, and then subjecting the steel sheet to hot-dip galvanizing:

$$0.85 \leqq \{[P(\text{wt. }\%)+(2/3)]\times 1150\}/\{T(^\circ\text{ C.})\} \leqq 1.15 \quad (2)$$

$$0.35 \leqq \{[P(\text{wt. }\%)+(2/3)]\times(-30)\}/\{t(^\circ\text{ C.})\} \leqq 1.8 \quad (3)$$

(22) A manufacturing method of a high strength hot-dip galvanized steel sheet excellent in workability and coating adhesion according to (3) above, comprising the steps of, after coiling the steel sheet at a temperature of up to 750° C., pickling the same, then cold-rolling the same, then heating the same at a heating temperature: T within a range of from 750° C. to 1,000° C. and satisfying equation (2) in an atmosphere gas having a dew point: t of an atmosphere gas satisfying the following equation (3) and a hydrogen concentration within a range of from 1 to 100 vol. %, and then subjecting the steel sheet to hot-dip galvanizing:

$$0.85 \leqq \{[P(\text{wt. }\%)+(2/3)]\times 1150\}/\{T(^\circ\text{ C.})\} \leqq 1.15 \quad (2)$$

$$0.35 \leqq \{[P(\text{wt. }\%)+(2/3)]\times(-30)\}/\{t(^\circ\text{ C.})\} \leqq 1.8 \quad (3)$$

(23) A manufacturing method of a high strength hot-dip galvanized steel sheet excellent in workability and coating adhesion according to any one of (11) to (22) above, wherein the slab further contains one or more selected from the group consisting of up to 1.0 wt. % Nb, up to 1.0 wt. % Ti and up to 1.0 wt. % V.

(24) A manufacturing method of a high strength hot-dip galvanized steel sheet excellent in workability and coating adhesion according to any one of (11) to (22) above, wherein the slab further contains one or more selected from the group consisting of from 0.001 to 1.0 wt. % Nb, from 0.001 to 1.0 wt. % Ti, and from 0.001 to 1.0 wt. % V.

(25) A manufacturing method of a high strength hot-dip galvanized steel sheet excellent in workability and coating adhesion according to any one of (11) to (24) above, wherein the coating weight of the high strength hot-dip galvanized steel sheet, as represented by the coating weight per side of the steel sheet, of from 20 to 120 g/$m^2$.

(26) A manufacturing method of a high strength hot-dip galvanized steel sheet excellent in workability and coating adhesion according to any one of (13), (14), (17), (18), (21) and (22) above, wherein, when the hydrogen concentration of the atmosphere gas is within a range of from 1 vol. % to under 100 vol. %, the remaining gas is an inert gas.

(27) A manufacturing method of a high strength hot-dip galvanized steel sheet excellent in workability and coating adhesion according to (26) above, wherein the inert gas is nitrogen gas.

(28) A manufacturing method of a high strength galvannealed steel sheet excellent in workability and coating adhesion, comprising the step of subjecting the hot-dip galvanized steel sheet obtained by the manufacturing method of a high strength hot-dip galvanized steel sheet according to any one of (11) to (27) above further to a galvannealing treatment.

(29) A manufacturing method of a high strength galvannealed steel sheet excellent in workability and coating adhesion, comprising the steps of subjecting the hot-dip galvanized steel sheet according to any one of (11) to (27) above further to a galvannealing treatment, wherein the temperature: $t_2$ (° C.) in the galvannealing treatment satisfies the following equation (4) relative to the P content in steel: P (wt. %) and the Al content: Al (wt. %) in the bath upon the hot-dip galvanizing:

$$0.95 \leq [7 \times \{100 \times [P(\text{wt. \%}) + (2/3)] + 10 \times Al(\text{wt. \%})\}]/[t_2(^\circ \text{ C.})] \leq 1.0 \quad (4)$$

(30) A manufacturing method of a high strength galvannealed steel sheet excellent in workability and coating adhesion according to (28) or (29) above, wherein the slab further contains one or more selected from the group consisting of up to 1.0 wt. % Nb, up to 1.0 wt. % Ti and up to 1.0 wt. % V.

(31) A manufacturing method of a high strength galvannealed steel sheet excellent in workability and coating adhesion according to (28) or (29) above, wherein the slab further contains one or more selected from the group consisting of from 0.001 to 1.0 wt. % Nb, from 0.001 to 1.0 wt. % Ti and from 0.001 to 1.0 wt. % V.

(32) A manufacturing method of a high strength galvannealed steel sheet excellent in workability and coating adhesion according to any one of (28) to (31) above, wherein the coating weight of the galvannealing layer of the high strength galvannealed steel sheet is within a range of from 20 to 120 g/m$^2$ as represented by the coating weight per side of the steel sheet.

(33) A high strength galvannealed steel sheet excellent in workability, coating adhesion and corrosion resistance, obtained by hot-dip galvanizing a steel sheet containing up to 1.00 wt. % Mo and then subjecting the steel sheet to galvannealing, wherein, in the galvannealing layer, the Fe content is within a range of from 8 to 11 wt. %, and the Mo content is within a range of from 0.002 to 0.11 wt. %.

(34) A high strength galvannealed steel sheet excellent in workability, coating adhesion and corrosion resistance, obtained by hot-dip galvanizing a steel sheet containing up to 1.00 wt. % Mo and from 0.010 to 0.2 wt. % C and then subjecting the steel sheet to galvannealing, wherein, in the galvannealing layer, the Fe content is within a range of from 8 to 11 wt. %, and the Mo content is within a range of from 0.002 to 0.11 wt. %.

(35) A high strength galvannealed steel sheet excellent in workability, coating adhesion and corrosion resistance according to (33) or (34) above, wherein the steel sheet containing up to 1.00 wt. % Mo contains Mo in an amount within a range of from 0.01 to 1.00 wt. %, ore preferably, from 0.05 to 1.00 wt. %.

(36) A high strength galvannealed steel sheet excellent in workability, coating adhesion and corrosion resistance according to any one of (33) to (35) above, wherein the substrate steel sheet serving as the steel sheet is a steel sheet comprising a chemical composition further containing up to 1.0 wt. % Si, from 1.0 to 3.0 wt. % Mn, up to 0.10 wt. % P, up to 0.05 wt. % S, up to 0.10 wt. % Al, up to 0.010 wt. % N, up to 1.0 wt. % Cr and the balance Fe and incidental impurities.

(37) A high strength galvannealed steel sheet excellent in workability, coating adhesion and corrosion resistance according to any one of (33) to (36), wherein the substrate steel sheet serving as the steel sheet further contains one or more selected from the group consisting of up to 1.0 wt. % Nb, up to 1.0 wt. % Ti and up to 1.0 wt. % V

(38) A high strength galvannealed steel sheet excellent in workability, coating adhesion and corrosion resistance according to any one of (33) to (36) above, wherein the substrate steel sheet serving as the steel sheet further contains one or more selected from the group consisting of from 0.001 to 1.0 wt. % Nb, from 0.001 to 1.0 wt. % Ti and from 0.001 to 1.0 wt. % V.

(39) A high strength galvannealed steel sheet excellent workability, coating adhesion and corrosion resistance according to any one of (33) to (38) above, wherein the coating weight of the galvannealing layer of the high strength galvannealed steel sheet is within a range of from 20 to 120 g/m$^2$ as represented by a coating weight per side of the steel.

BEST MODE FOR CARRYING OUT THE INVENTION

First, the result of experiment carried out to improve mechanical properties and forming the basis for the present invention will be described.

A sheet bar having a chemical composition comprising 0.09 wt. % C, 0.01 wt. % Si, 2.0 wt. % Mn, 0.009 wt. % P, 0.003 wt. % S, 0.041 wt. % Al, 0.0026 wt. % N, 0.15 wt. % Mo, 0.02 wt. % Cr, and the balance substantially Fe, and having a thickness of 30 mm was heated to 1,200° C., rolled into a hot-rolled steel sheet having a thickness of 2.5 mm through five passes. The hot-rolled steel sheet was coiled at 640° C., pickled, heating and held at a temperature within a range of from 750 to 900° C. for a minute (first run of heating), and then, cooled to the room temperature at a cooling rate of 10° C./s.

Then, the steel sheet was heated and held at 750° C. for a minute (second run of heating), cooled to 500° C. at a cooling rate of 10° C./s, held for 30 seconds, heated to 550° C. at a heating rate of 10° C./s, and immediately holding for 20 seconds, cooled to the room temperature at a cooling rate of 10° C./s.

For the resultant steel sheet, the relationship between TS, YR and TS×El value, on the one hand, and the band structure thickness on the thickness direction in cross-section of the steel sheet after the first run of heating, on the other hand, was investigated. The result is shown in FIG. 1.

The band structure thickness is expressed by Tb/T (where, Tb: thickness of the band structure in the thickness direction comprising a secondary phase, T: steel sheet thickness).

Tb is an average over values obtained by measurement of all the band structures in the thickness direction in a image of 1,500 magnification by means of an image analyzer.

Figure 1:
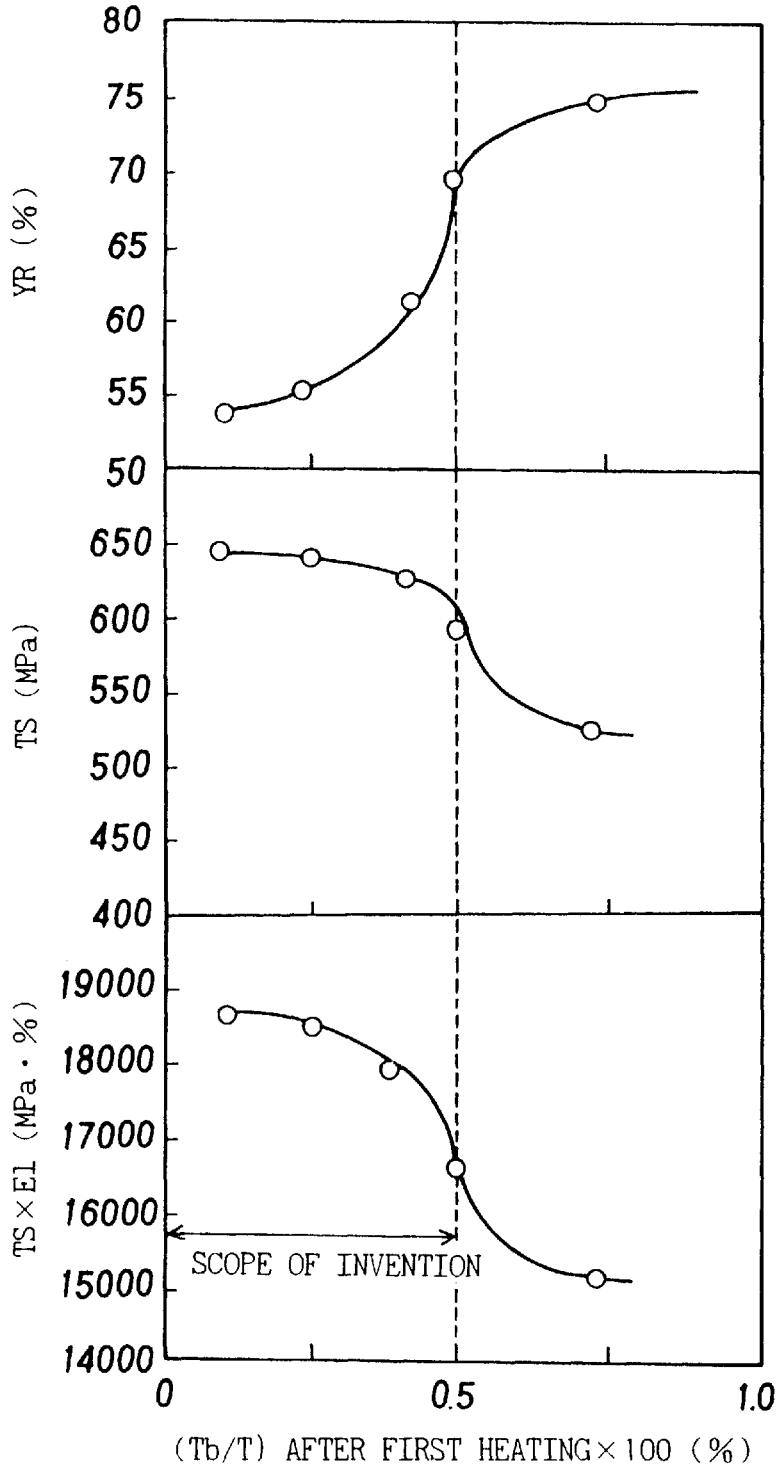
FIG. 1 is a graph illustrating the relationship between tensile strength (TS), yield ratio (YR) and TS×El value of a steel sheet, on the one hand, and the [average thickness of band-shaped secondary phase Tb/thickness T], on the other hand.

FIG. 1 reveals that a Tb/T of up to 0.005 in the steel sheet after the first run of heating leads to a low yield ratio and a satisfactory TS×El value.

More specifically, when Mn is added in a large quantity for the purpose of ensuring a high strength as in the present invention, a band structure rich in C and Mn, comprising mainly the secondary phase composed of cementite, pearlite and bainite tends to easily grow.

In such a case, it is possible to simultaneously achieve a good workability and a high tensile strength by carrying out the first run of heating at a prescribed temperature on a facility such as a continuous annealing line, prior to conducting heating on a continuous hot-dip galvanizing line (CGL) (second run of heating), which reduces the band structure thickness, through fine dispersion of band structures. Even when the band structures are dissolved during heating on the continuous hot-dip galvanizing line and held in the galvanizing process or even during galvannealing treatment, martensite grains are appropriately dispersed in the ferrite substrate.

This is a phenomenon which may take place when the steel sheet is heated at a high temperature on the continuous hot-dip galvanizing line. Even with a single run of heating on the continuous hot-dip galvanizing line, there is no charge in material quality.

However, a high-temperature heating may cause deterioration of galvanizability because of the tendency of Mn concentrated on the steel sheet surface. In order to achieve a more stable galvanizability, therefore, it is desirable to conduct a first run of heating on the continuous annealing line, and more preferably, to carry out a second run of heating on the continuous hot-dip galvanizing line.

Figure 2:
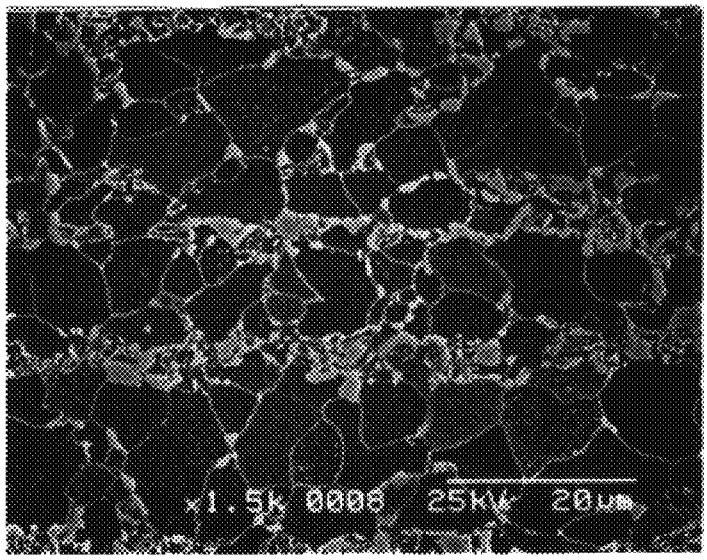
FIG. 2 illustrates a microphotograph (a) of a metal structure showing a typical band-shaped secondary phase structure and a schematic view (b) of the metal structure.
Figure 2:
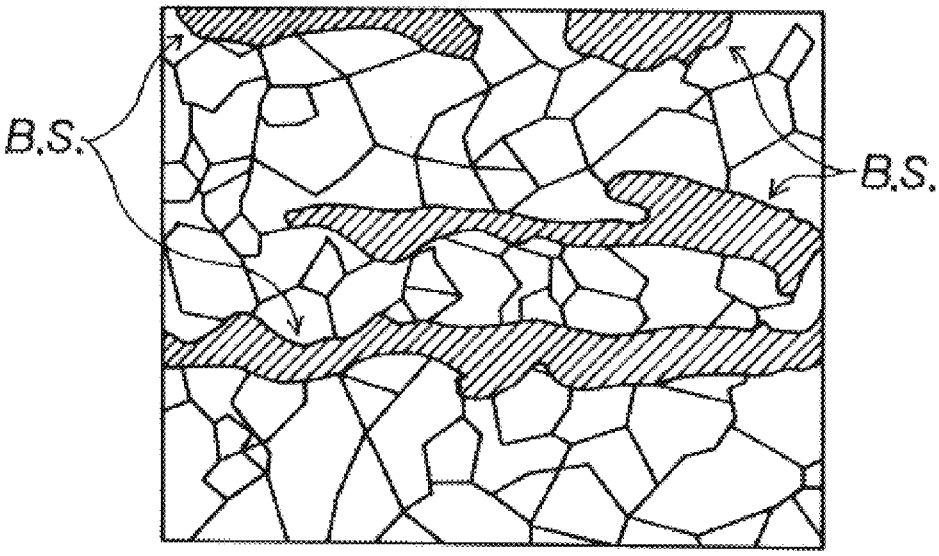
Figure 3:
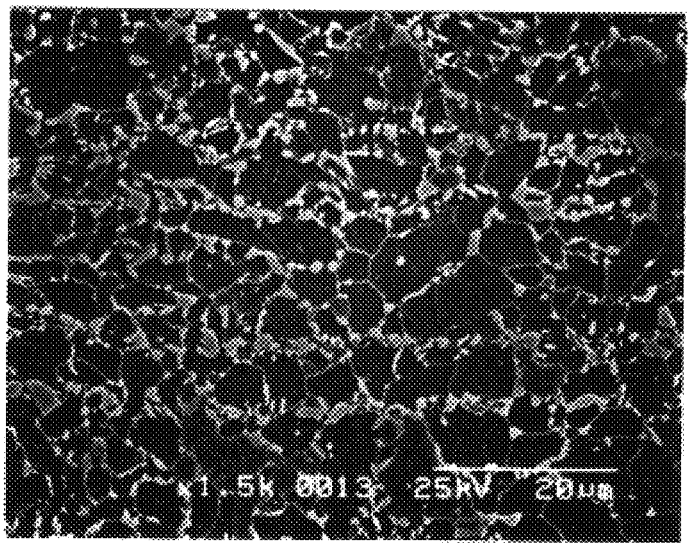
FIG. 3 illustrates a microphotograph (a) of a metal structure showing a state in which the secondary phase structure dispersed by the first run of heating, and a schematic view (b) of the metal structure.
Figure 3:
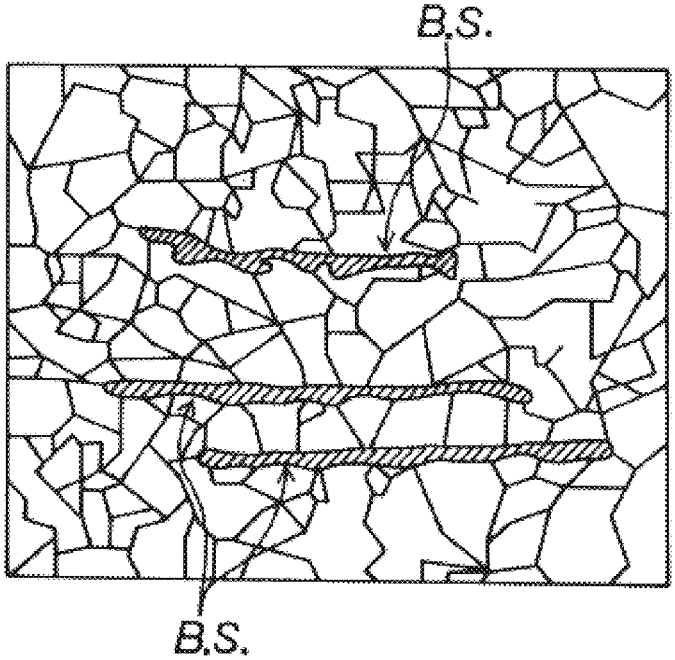

This dispersion effect of the band structures brought about by the first run of heating is evident from the comparison of microphotographs illustrated in FIGS. 2 and 3.

FIG. 2(*a*) illustrates a metal structure before the first run of heating, and FIG. 2(*b*) is a schematic view of FIG. 2(*a*).

FIG. 3(*a*) illustrates a metal structure after the first run of heating, and FIG. 3(*b*) is a schematic view of FIG. 3(*a*).

In FIGS. 2(*b*) and 3(*b*), B.S. represents band structures comprising a secondary phase mainly consisting of cementite, pearlite, bainite, and very partially martensite and residual austenite.

In the structure before the first run of heating shown in FIG. 2, Tb/T takes a value of 0.0070 on the average. In the structure after the first run of heating shown in FIG. 3, in contrast, dispersion of band structures is attempted, and the value of Tb/T decreases to 0.0016 on the average.

The present invention for further improving galvanizability will now be described in detail.

As a result of studies on the composition of the substrate steel sheet annealing conditions and galvannealing conditions necessary for preventing non-galvanized defects and improving workability and coating adhesion, the present inventors obtained the following findings (1) to (3) and developed the present invention.

(1) Two-stage Heating-pickling Process

A high strength hot-dip galvanized steel sheet permitting prevention of non-galvanized defects and excellent in coating adhesion and corrosion resistance is available by heating a steel sheet having a prescribed chemical composition to a temperature of at least 750° C., or preferably, at least 800° C. in an annealing furnace, cooling the same, pickling the steel sheet to remove a concentrated layer of steel constituents on the steel sheet surface, then annealing again the steel sheet on a continuous hot-dip galvanizing line in a prescribed reducing atmosphere at an appropriate heating-reduction temperature and then subjecting the steel sheet to hot-dip galvanizing.

The aforementioned method of treatment prior to hot-dip galvanizing (:heating in annealing furnace→pickling→heating-reduction) is hereinafter called the two-stage heating-pickling process.

(2) Single-stage Heating Process

As a result of further studies, availability was found of satisfactory galvanizability and coating adhesion by single-stage heating by heating a steel sheet having a prescribed chemical composition at an appropriate heating temperature in a hydrogen-containing gas having an appropriate dew point, and then subjecting the steel sheet to hot-dip galvanizing.

The aforementioned heating method prior to hot-dip galvanizing (;heating-reduction) will hereinafter be called also the single-stage heating process.

(3) Galvannealing Process

Availability was found of a high strength galvannealed steel sheet excellent both in coating adhesion and corrosion resistance after galvannealing by annealing the hot-dip galvanized steel sheet obtained in (1) and (2) above preferably under conditions satisfying a prescribed galvannealing temperature requirement.

Experiments forming the basis for the present invention for improving the aforementioned galvanizability will now be described.

[Two-stage Heating-pickling Process]

A sheet bar having a chemical composition comprising 0.09 wt. % C, 0.01 wt. % Si, 2.0 wt. % Mn, from 0.005 to 0.1 wt. % P, 0.003 wt. % S, 0.041 wt. % Al, 0.0026 wt. % N, 0.15 wt. % Mo, 0.02 wt. % Cr and the balance substantially Fe, and having a thickness of 30 mm was heated to 1,200° C., and rolled into a hot-rolled steel sheet having a thickness of 2.5 mm through five passes.

The resultant hot-rolled steel sheet was treated in the sequence of the following (1) to (10):

(1): heat treat at 540° C. for 30 minutes, and subjected to a treatment corresponding to coiling;

(2): pickled for 40 seconds in a 5 wt. % HCl solution having a liquid temperature of 80° C.;

(3): held at 800° C. (steel sheet temperature) for a minute in a reducing atmosphere containing hydrogen in an annealing furnace;

(4): cooled to the room temperature at a cooling rate of 10° C./s;

(5): pickled for 10 seconds in a 5 wt. % HCl solution having a liquid temperature of 60° C.;

(6): held for 20 seconds at 650 to 950° C. (steel sheet temperature) in a reducing atmosphere containing hydrogen;

(7): cooled to 480° C. at a cooling rate of 10° C./s;

(8): subjected to hot-dip galvanizing by dipping for a second into a hot-dip galvanizing bath containing 0.15 wt. % Al and having a bath temperature of 480° C.;

(9): the coating weight of the galvanized steel sheet pulled up from the hot-dip galvanizing bath is objected to 50 $g/m^2$ through gas wiping;

(10): immediately after heating-reduction under conditions including an $H_2$ concentration of 7 vol. %, a dew point (:dp) of −25° C. and a steel sheet temperature of 800° C., subjected to hot-dip galvanizing under the above-mentioned conditions, and the resultant hot-dip galvanized steel sheet is subjected to a galvannealing treatment at 450 to 60° C.

Then, properties of the resultant steel sheet were evaluated with the following method of evaluation and criteria.

[Galvanizability]

The exterior view of the hot-dip galvanized steel sheet (hot-dip galvanized steel sheet not as yet galvannealed) was visually inspected.

○: Non-galvanized defects completely non-existent (good galvanizability);

X: Non-galvanized defects occurred.

[Coating Adhesion]

The galvanized steel sheet was bent to 90° and straightened, then the galvanizing layer on the compressed side was peeled off with a cellophane tape, and evaluation was made on the basis of the amount of galvanizing film adhering to the cellophane tape.

(Galvanized Steel Sheet not as Yet Galvannealed)

○: No peeling of the galvanizing layer (good coating adhesion)

X: The galvanizing layer was peeled off (defective coating adhesion (Galvannealed Steel Sheet)

○: Small amount of peeled galvanizing layer (good coating adhesion)

X: Large amount of peeled galvanizing layer (poor coating adhesion)

[Exterior View After Galvannealing]

The exterior view after galvannealing was visually evaluated.

○: Uniform exterior view without unevenness of galvannealing

X: Unevenness of galvannealing occurs

Figure 4:
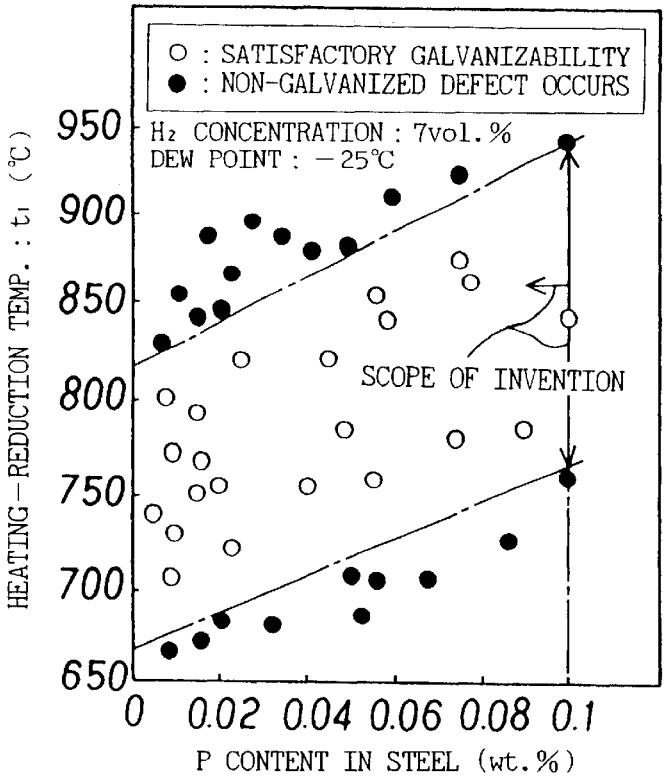
FIG. 4 is a graph illustrating the relationship between the P content in steel and the optimum heating-reduction temperature region within which non-galvanized defects do not occur.
Figure 5:
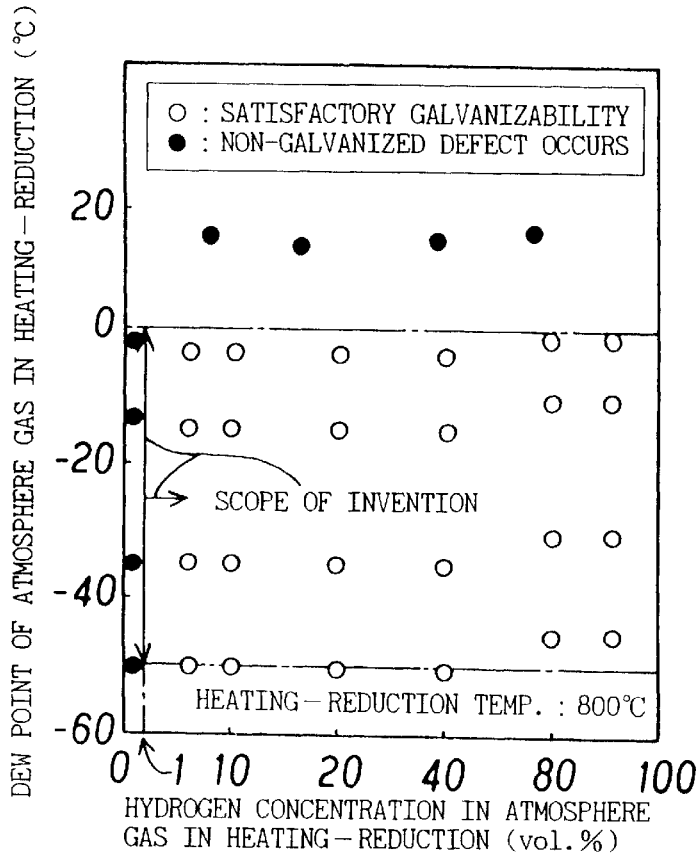
FIG. 5 is a graph illustrating the optimum regions for the hydrogen concentration and dew point of the atmosphere gas during heating-reduction in which non-galvanized defects do not occur.
Figure 6:
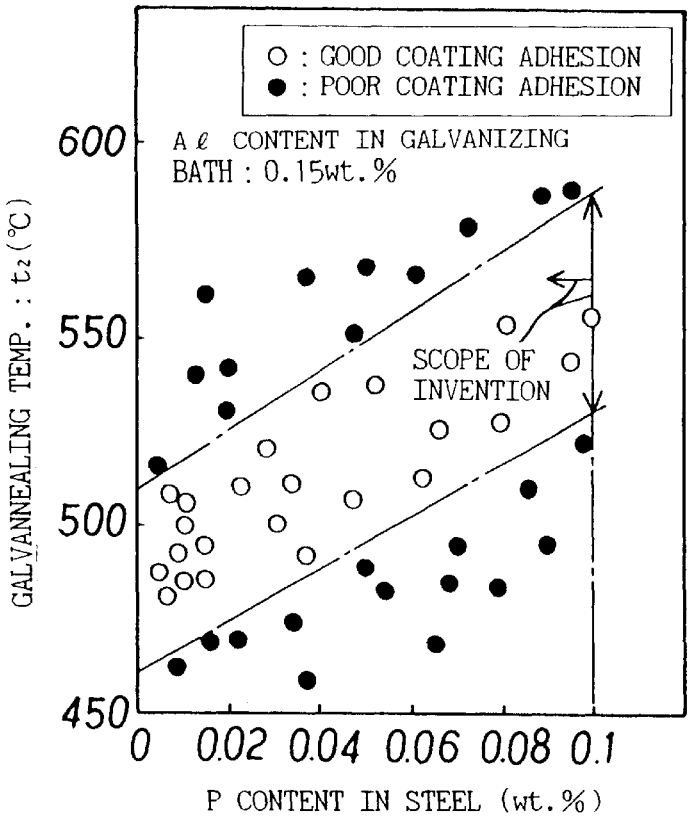
FIG. 6 is a graph illustrating the relationship between the P content in steel and the optimum galvannealing temperature region giving a satisfactory coating adhesion.

FIGS. 4 and 5 illustrate the result of evaluation of galvanizability of the hot-dip galvanized steel sheet, and FIG. 6 illustrates the result of evaluation of coating adhesion of the galvannealed steel sheet.

In order to ensure a good galvanizability, as shown in FIGS. 4 and 5, it is necessary to provide conditions under which P-based oxides are thermodynamically reduced, determined from the dew point of the atmosphere gas, hydrogen concentration and the steel sheet heating temperature during heating-reduction upon applying hot-dip galvanizing.

In FIG. 4, the heating-reduction temperature (steel sheet temperature) within the scope of the invention during heating-reduction: $t_1$ (° C.) is expressed by the following equation (1):

$$0.9 \leqq \{[P(\text{wt. }\%)+(2/3)]\times 1100\}/\{t_1(^\circ\text{ C.})\} \leqq 1.1 \quad (1)$$

In the equation (1), P (wt. %) represents the P content in steel.

Further, when galvannealing a hot-dip galvanized steel sheet, in order to ensure a satisfactory coating adhesion, the necessity was revealed to satisfy an galvannealing temperature (steel sheet temperature) requirement within the scope of the invention shown in FIG. 6.

In FIG. 6, the galvannealing temperature (steel sheet temperature) within the scope of the invention: $t_2$ (° C.) is expressed by the following equation (4):

$$0.95 \leqq [7\times\{100\times[P(\text{wt. }\%)+(2/3)]+10\times Al(\text{wt. }\%)\}]/[t_2(^\circ\text{ C.})] \leqq 1.05 \quad (4)$$

In the above equation (4), P (wt. %) represent the P content in steel, and Al (wt. %) represents the Al content in the bath during hot-dip galvanizing.

More specifically, according to findings of the present inventors, as a method for improving galvanizability of a steel sheet containing much Mn or other easily oxidizable elements such as a high strength steel, it is possible to manufacture a high strength hot-dip galvanized steel sheet without occurrence of non-galvanized defects by once annealing the steel sheet in an annealing furnace, causing precipitation of surface concentrates of easily oxidizable elements such as Mn on the steel sheet surface, removing concentrates through pickling, heating-reducing the steel sheet under appropriate atmosphere gas conditions determined from the dew point of the atmosphere gas, the hydrogen concentration and the steel sheet temperature, in which P-based oxides are thermodynamically reduced, and immediately subjecting the steel sheet to hot-dip galvanizing.

When applying an galvannealing treatment after hot-dip galvanizing, it is possible to manufacture a high strength galvannealed steel sheet excellent in coating adhesion after galvannealing by carrying out an galvannealing treatment at an appropriate temperature in response to the P content in steel and the Al content in the bath during hot-dip galvanizing.

Further, the present inventors tried to manufacture galvannealed steel sheets made from a steel substrate having the same chemical composition as that of the hot-rolled steel sheet used in the above-mentioned experiment of the two-stage heating-pickling process, having an Fe content of 10 wt. % in the galvanizing layer after galvannealing and an Mo content of 0.01 wt. % in the galvanizing layer, and a galvannealed steel sheet made from a steel substrate having the same chemical composition as above except for Mo alone, having an Fe content of 10 wt. % in the galvanizing layer after galvannealing, and an Mo content of 0 wt. % in the galvanizing layer.

Figure 7:
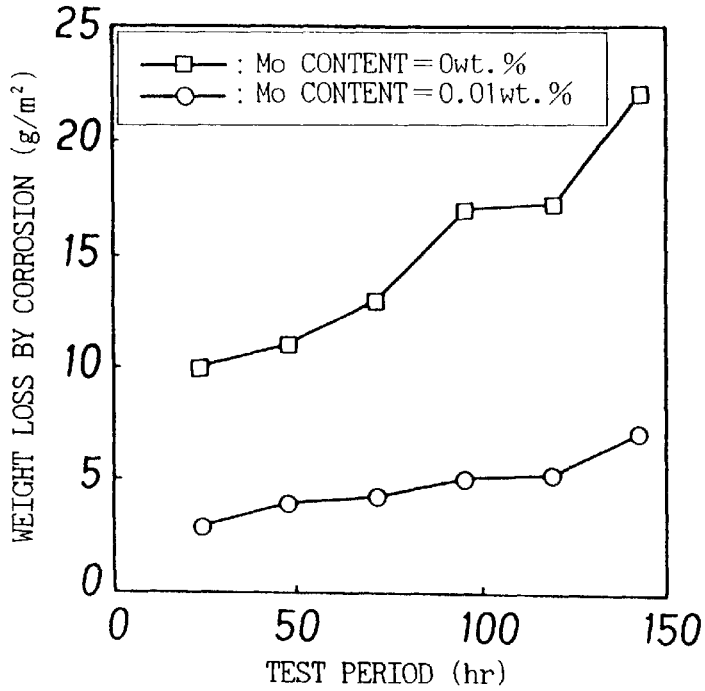
FIG. 7 is a graph illustrating the relationship between the Mo content in the galvanizing layer and the weight loss by corrosion.

FIG. 7 illustrates the result of an SST test (salt spray test) carried out on the resultant galvannealed steel sheets.

As shown in FIG. 7, the galvannealed steel sheet containing Mo showed a lower weight loss by corrosion and a largely improved corrosion resistance as compared with the galvannealed steel sheet not containing Mo.

[Single-stage heat treatment]

The present inventors carried out further experiments similar to the above with a view to simplifying the aforementioned two-stage heating treatments and the process comprising pickling performed between the these heating treatments.

As a result, they found the possibility to manufacture a high strength hot-dip galvanized steel sheet excellent in galvanizability and coating adhesion through single-stage heating without conducting pickling on the hot-dip galvanizing line, irrespective of the presence of added Mo, by hot-rolling a steel slab having a prescribed chemical composition, pickling the same, then with or without cold rolling, heating the steel sheet in an annealing furnace in an atmosphere gas in which the heating temperature: T within a range of from 750° C. to 1,000° C. satisfies the following equation (2) and the dew point of the atmosphere gas: t satisfies the following equation (3), with a hydrogen concentration within a range of from 1 to 100 vol. %:

$$0.85 \leqq \{[P(\text{wt. }\%)+(2/3)]\times 1150\}/\{T(^\circ\text{ C.})\} \leqq 1.15 \quad (2)$$

$$0.35 \leqq \{[P(\text{wt. }\%)+(2/3)]\times(-30)\}/\{t(^\circ\text{ C.})\} \leqq 1.8 \quad (3)$$

Figure 8:
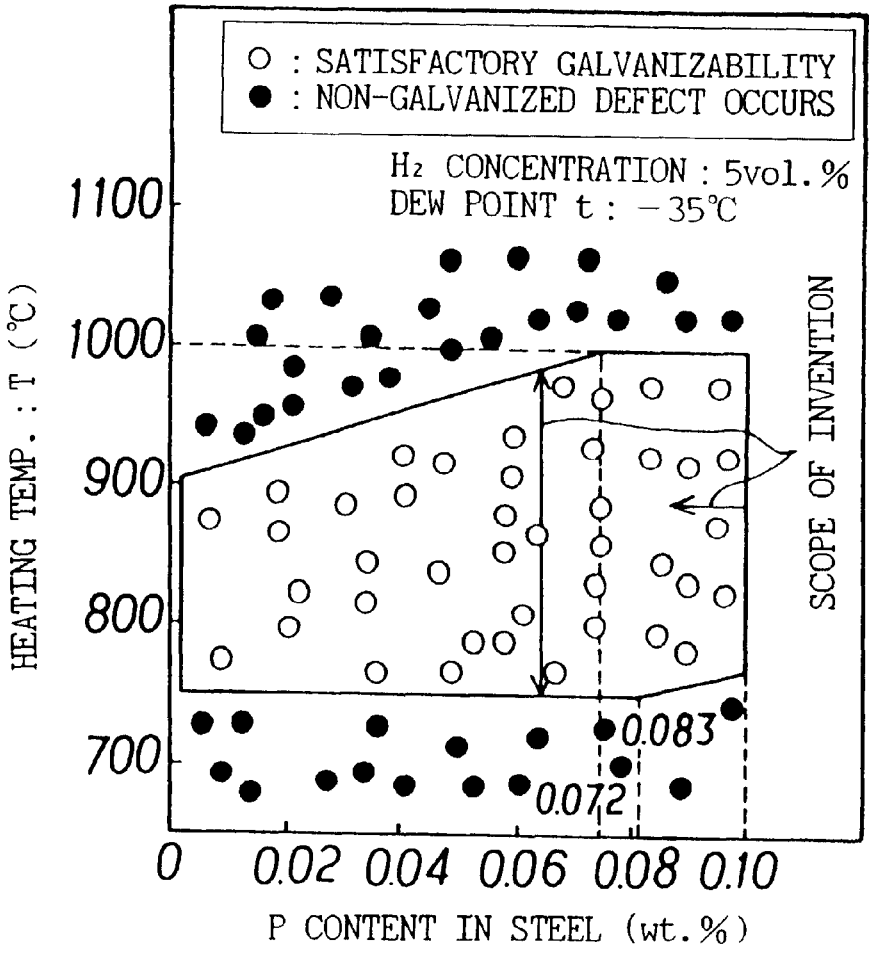
FIG. 8 is a graph illustrating the relationship between the P content in steel, and the optimum heating-reduction temperature region within which non-galvanized defects do not occur.
Figure 9:
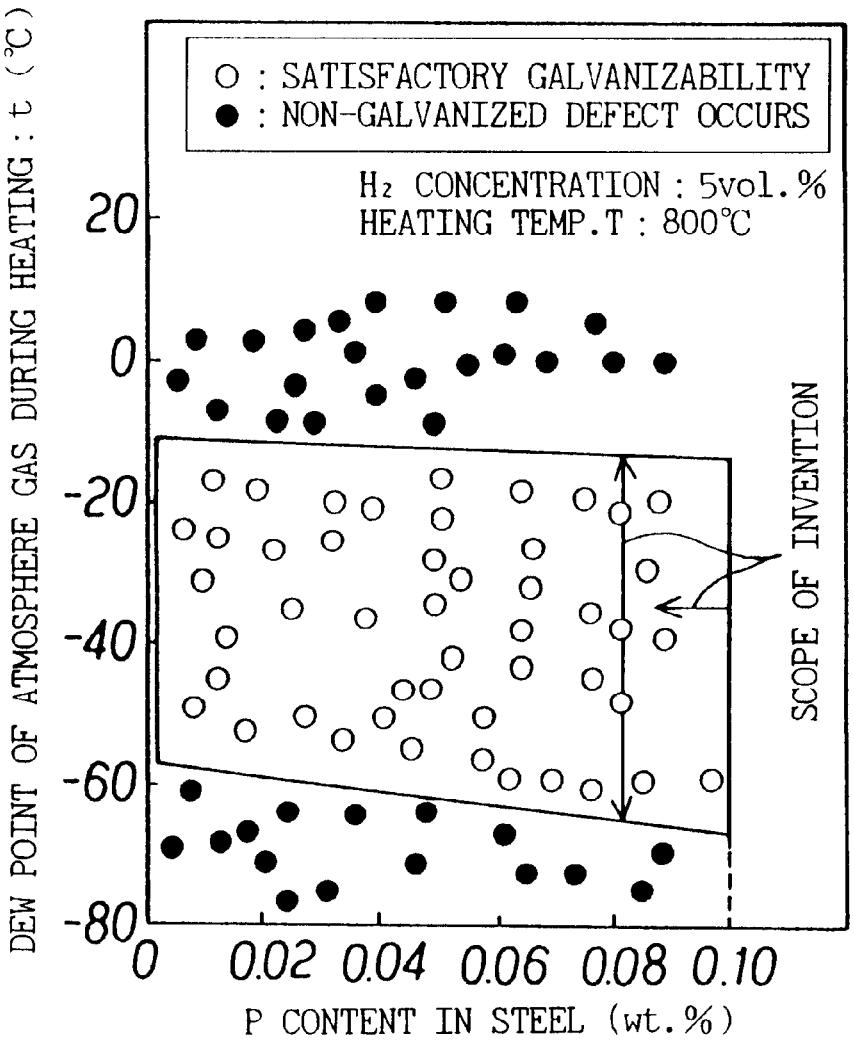
FIG. 9 is a graph illustrating the relationship between the P content in steel and the optimum region of dew point of the atmosphere gas during heating-reduction in which non-galvanized defect do not occur.

FIGS. 8 and 9 illustrate the result of evaluation of galvanizability of a hot-dip galvanized steel sheet in a case where a cold-rolled steel sheet made from a steel substrate not added with Mo was cold-rolled, heated in an $H_2$-$N_2$ atmosphere on a hot-dip galvanizing line, without conducting annealing and pickling, and the resultant steel sheet was subjected to hot-dip galvanizing.

As shown in FIGS. 8 and 9, it is possible to manufacture a high strength hot-dip galvanized steel sheet excellent in galvanizability and coating adhesion through single-stage heating without conducting pickling on the hot-dip galvanizing line, irrespective of the presence of added Mo, by heating the steel sheet under conditions, of a hydrogen-containing gas in which the heating temperature: T and the atmosphere gas dew point: t are strictly controlled as a preceding process of hot-dip galvanizing.

In FIG. 8, the heating temperature (steel sheet temperature): T (° C.) within the scope of the invention upon heating prior to hot-dip galvanizing is within any of the following ranges:

When P (wt. %)≦0.072 wt. %:

$$0.85 \leqq \{[P(\text{wt. }\%)+(2/3)]\times 1150\}/\{T(^\circ\text{ C.})\} \text{ and, } 750^\circ\text{ C.} \leqq T(^\circ\text{ C.}).$$

When 0.072 wt. %≦P(wt. %)≦0.083 wt. %:

$$750^\circ\text{ C.} \leqq T(^\circ\text{ C.}) \leqq 1000^\circ\text{ C.}$$

When 0.083 wt. %≦P(wt. %)≦0.10 wt. %:

$$\{[P(\text{wt. }\%)+(2/3)]\times 1150\}/\{T(^\circ\text{ C.})\} \leqq 1.15 \text{ and, } 1000^\circ\text{ C.} \leqq T(^\circ\text{ C.}).$$

In FIG. 9, the dew point: t (° C.) of the atmosphere gas within the scope of the invention upon heating prior to hot-dip galvanizing is within the following range:

$$0.35 \leqq \{[P(\text{wt. }\%)+(2/3)]\times(-30)\{/\}t(^\circ\text{ C.})\} \leqq 1.8.$$

The reasons of limitations of I. the chemical composition of the steel substrate, and II. manufacturing conditions in the present invention will now be described.

I. Chemical Composition of Steel Substrate

C: 0.01 to 0.20 wt. %

C is one of the important basic constituents of steel, and particularly in the invention, is an important element because of its effect on volume ratio of γ-phase when heated in the (γ+α) region, and hence on the amount of martensite after cooling. Mechanical properties such as strength are largely dependent on martensite percentage and hardness of martensite phase. With a C content of under 0.01 wt. %, the martensite is hardly formed, and with a C content of over 0.20 wt. %, there is deterioration of spot weldability. The C content should therefore be within a range of from 0.01 to 0.20 wt. %, or preferably, from 0.03 to 0.15 wt. %.

Si: up to 1.0 wt. %

Si is an element causing improvement of workability such as elongation by reducing the solute C content in the α-phase. A content of Si of over 1.0 wt. % however impairs spot weldability and galvanizability. The upper limit should therefore be 1.0 wt. %. The Si content should more preferably be up to 0.5 wt. %.

Mn: 1.0 to 3.0 wt. %

Mn has a function of accelerating martensite transformation through concentration in the γ-phase in the invention, and is an important element as a basic constituent. Addition of an amount under 1.0 wt. % exerts no effect. An Mn content of over 3.0 wt. %, on the other hand, seriously impairs spot weldability and galvanizability. The Mn content should therefore be added within a range of from 1.0 to 3.0 wt. %, or preferably, from 1.5 to 2.5 wt. %.

P: up to 0.10 wt. %

P is effective for obtaining a high strength steel sheet and is an inexpensive element. A P content of over 0.10 wt. % seriously impairs spot weldability. The P content for the steel substrate is therefore limited to up to 0.10 wt. %. In the invention, the P content in the steel substrate should preferably be within a range of from 0.005 to 0.05 wt. %.

S: up to 0.05 wt. %

S forms a factor causing hot cracks during hot rolling, and in addition, causes fracture in nugget at a spot weld. The amount of S should therefore be reduced as far as possible. For this purpose, the S content of the steel substrate should be up to 0.05 wt. % in the invention. The S content should preferably limited to up to 0.010 wt. %.

Al: up to 0.10 wt. %

Al is a useful element serving as a deoxidizer in the steel making process, and fixing N causing age hardening in the form AlN. An Al content of over 0.10 wt. % however leads to an increase in manufacturing cost. The Al content should therefore be limited to up to 0.10 wt. %, or preferably, to up to 0.050 wt. %.

N: up to 0.010 wt. %

N causes age hardening and leads to an increase in yield point (yield ratio) and occurrence of yield elongation. The N content should therefore be limited to up to 0.010 wt. %, or preferably, to up to 0.0050 wt. %.

Cr: up to 1.0 wt. %

Like Mn and Mo, Cr is an element effective for obtaining a ferrite+martensite composite structure. A Cr content of over 1.0 wt. % however impairs galvanizability. The Cr content should therefore be limited to up to 1.0 wt. %, or preferably, to up to 0.5 wt. %.

Mo: 0.001 to 1.00 wt. %

Like Mn, Mo is an element effective for obtaining a ferrite+martensite composite structure to intensify solute without impairing galvanizability.

According to the invention, furthermore, the Mo-added steel sheet showed a better reducibility of P-based pickling residues (P-based oxides), an object of the invention, and had an effect of improving coating adhesion, as compared with the steel sheet not containing added Mo.

An accurate cause of this effect is not as yet known. It is however conjectured that Mo incorporating P forms a condensed acid; Mo is incorporated in some form or other into P-based oxides; and this promotes reduction of the P-based pickling residues because this reduces the oxygen potential sensed by the dissolved residues, this resulting in improvement of coating adhesion.

When using a substrate steel sheet containing added Mo, the resultant steel sheet tends to have an improved corrosion resistance. Mo is an element hardly oxidizable than Fe, and light diffusion and addition of Mo into the galvanizing layer is considered to cause improvement of corrosion resistance. In the invention, with a view to achieving the aforementioned effects, the Mo content in the substrate steel sheet should be at least 0.001 wt. %. However, since addition in an amount of over 1.00 wt. % results in a considerable increase in the manufacturing cost, the Mo content is specified to be up to 1.00 wt. %. In the invention, the Mo content in the substrate steel sheet should preferably be within a range of from 0.01 to 1.00 wt. %, or more preferably, from 0.05 to 1.00 wt. %. The most desirable Mo content in the substrate steel sheet in the invention is within a range of from 0.05 to 0.5 wt. %.

Ti: 0.001 to 1.0 wt. %, Nb: 0.001 to 1.0 wt. %, V: 0.001 to 1.0 wt. %

Ti, Nb and V form carbides, and are elements effective for converting steel into a high strength steel. Each of these elements should preferably be added in an amount of at least 0.001 wt. %. Addition of these elements in an amount of over 1.0 wt. % however leads to disadvantage in cost, increases yield point (yield ratio), and reduces workability. When adding these elements, therefore, these elements are added each in an amount within a range of from 0.001 to 1.0 wt. %. The total amount of these elements should preferably be within a range of from 0.001 to 1.0 wt. %.

II. Manufacturing Conditions

Manufacturing conditions for II-1: a high strength thin steel sheet of which the band structure thickness is specified; II-2: Two-stage heating-pickling process; II-3: single-stage heating treatment process; and II-4: Hot-dip galvanizing and galvannealing treatment process will now be described in this sequence.

II-1: Manufacturing conditions of high strength thin steel sheet of which the band structure thickness is specified In the present invention, a steel slab having the above-mentioned chemical composition is hot-rolled by the conventional method, and coiled at a temperature of up to 750° C.

The reason of limiting the coiling temperature to up to 750° C. is as follows. Coiling at a temperature of over this level results in an increase in the scale thickness, and in a poorer pickling efficiency. In addition, there occurs a considerable difference in cooling rate after coiling at the longitudinal leading end of the foil, at the center portion thereof, and the trailing end thereof, and the edge portion and center portion in the transverse direction of the coil, and the causes serious fluctuations of the material quality. The coiling temperature should preferably be up to 700° C. Since a very low coiling temperature tends to easily cause deterioration of cold-rollability, it is desirable to pay attention so that the coiling temperature does not become lower than 300° C.

The hot-rolled steel obtained as described above is used as a substrate steel sheet for galvanizing by descaling through pickling, heating the same at a temperature of at least 750° C. with or without further cold rolling, and then cooling the same.

According to the present invention, workability is improved by once heating, prior to galvanizing, the steel sheet to a temperature region of at least 750° C. (suitable for a continuous annealing line) to dissolve and disperse C and Mn concentrated in the band structures, and after cooling, causing formation of a composite ferrite+martensite structure.

More specifically, when much Mn is contained as in the present invention, a band structure mainly comprising cementite, pearlite and bainite tends to be easily formed. It is therefore necessary to previously exclude the adverse effect of this structure.

By setting the relationship between the average thickness Tb of the band structure and the sheet thickness T to $(Tb/T) \leqq 0.005$, reducing the band structure thickness within this range and finely dispersion the same, it is possible, after cooling, to appropriately disperse the martensite phase in the ferrite base, and simultaneously achieve a high workability and a high strength, even when the band structure is dissolved during heating on the continuous hot-dip galvanizing line, and held in this state during galvanizing, or further, during galvannealing step.

The effect of dispersion of the band structure by heating (first run of heating) prior to galvanizing is as shown in FIGS. 1 to 3 as described above.

Whether or not carrying out pickling and descaling during the period between coiling after hot rolling and the first run of heating has no influence on the effect of the invention.

When galvanizing the thus manufactured substrate for galvanizing into a thin steel sheet, a pickling treatment may be carried out prior to galvanizing after the first run of heating.

This pickling is applied for the purpose of improving galvanizability to a more stable level by removing the surface concentrated layer of Mn, Cr and the like produced along with heating.

During the period between the first run of heating and the pickling treatment, temper rolling may be conducted with a view to improving threadability off the subsequent line.

Then, the steel sheet is subjected to hot-dip galvanizing or electrogalvanizing.

When carrying out hot-dip galvanizing, the steel sheet is reheated to a temperature of at least 700° C. (first or second run of heating) on the hot-dip galvanizing line (GL) prior to galvanizing.

With a heating temperature prior to galvanizing of up to 700° C., the steel sheet surface is not reduced, tending to easily cause galvanizing defects, and desired structure and material quality are not available. Heating should therefore be carried out at a temperature of at least 700° C.

The reheating temperature prior to galvanizing should preferably be within a range of from 750 to 900° C.

In the invention, hot-dip galvanizing may be followed by the galvannealing treatment.

Electrogalvanizing may be conducted in place of hot-dip galvanizing, and an effect equivalent to that of hot-dip galvanizing is available also in this case.

II-2: Manufacturing conditions for two-stage heating-pickling (:heating in annealing furnace→pickling→heating-reduction→hot-dip galvanizing):

In the invention, a steel slab comprising the above-mentioned chemical composition is hot-rolled by the conventional method and the resultant hot-rolled sheet in coiled at a temperature of up to 750° C.

Then, the resultant hot-rolled steel sheet is pickled to descale the steel sheet.

The thus obtained steel sheet may be directly subjected to the subsequent annealing and galvanizing steps, or may be subjected to annealing and galvanizing steps after cold rolling.

That is, the substrate steel sheet of the galvanized steel sheet in the invention may be any of a hot-rolled steel sheet or a cold-rolled steel sheet.

The heating temperature during annealing of the steel sheet in an annealing furnace should be at least 750° C., or preferably within a range of from 750 to 1,000° C., or more preferably, from 800 to 1,000° C.

With a temperature of under 750° C., easily oxidizable elements such as Mn generally contained in a high strength steel sheet are concentrated on the steel sheet surface in a slight amount, and therefore concentrated again immediately before galvanizing.

For a steel sheet containing much Mn as in the steel sheet of the invention, Mn concentrated in band structures in the substrate steel sheet cannot be dispersed, and galvanizing defects tend to occur. It is therefore necessary to cause sufficient surface concentration of easily oxidizable elements such as Mn in the surface layer of the substrate steel sheet by subjecting the steel sheet to annealing at a temperature of at least 750° C., or preferably at least 800° C.

With a heating temperature in the annealing furnace of over 1,000° C, the steel comes off the $\alpha$–$\gamma$ dual phase. Desired structure and material quality are therefore unavailable. The heating temperature in the annealing furnace should preferably be up to 1,000° C.

After annealing and subsequent cooling, the concentrated layer of the steel constituents on the steel sheet surface are removed through pickling.

The acid of the pickling solution in pickling is not limited to HCl, but $H_2SO_4$ and $HNO_3$ are also applicable, and no particular limitation is imposed on the kind of acid.

The pickling solution upon pickling described above in steps subsequent to the annealing furnace should have a pH of up to 1. When using hydrochloric acid, the HCl concentration should preferably be within a range of from 1 to 10 wt. %.

When pH of the pickling solution is over 1, the removing effect of the surface concentrates by pickling becomes insufficient.

With an HCl concentration of under 1 wt. %, the removing effect of the surface concentrates by pickling becomes insufficient. An HCl concentration of over 10 wt. % is not appropriate because it causes steel sheet surface roughing by over-pickling, and leads to a large consumption of the acid.

The liquid temperature of the pickling solution should preferably be within a range of from 40 to 90° C. With a temperature of under 40° C., the removing effects of the surface concentrates by pickling becomes insufficient. With a temperature of over 90° C., on the other hand, surface roughing occurs by over-pickling.

The liquid temperature of the pickling solution should preferably be within a range of from 50 to 70° C.

The pickling period should preferably be within a range of from 1 to 20 seconds. A period of under 1 second leads to an insufficient removing effect of concentrates on the steel sheet surface by pickling. A period of over 20 seconds is not appropriate because of occurrence of roughing of the steel sheet surface by over-pickling, a longer manufacturing period, and a lower productivity.

The pickling period should preferably be within a range of from 5 to 10 seconds. Then, for example, the steel sheet having been subjected to the treatment in the above-mentioned steps is heating-reduced again in a reducing atmosphere in a heating furnace arranged on a continuous hot-dip galvanizing line, and then subjected to hot-dip galvanizing.

The oxide film produced after pickling on the steel sheet surface (pickling residues) contains Fe and hardly soluble P caused by P in steel. Occurrence of non-galvanized defects cannot therefore be prevented unless this P-based oxide film (P-based oxides) is reduced.

Because the P-based oxide film is caused by P in steel, a larger P content in steel leads to a larger amount of produced P-based oxide film.

P-based oxides produced on the steel sheet surface include iron phosphate compounds, in general mainly composed of phosphate ion ($PO_4^{3-}$), hydrophosphate and dihydrophosphate ion ($HPO_4^{2-}$,$H_2PO_4^-$), hydroxyl group ($OH^-$) and iron ion ($Fe^{3+}$, $Fe^{2+}$), and phosphorus oxides such as $P_2O_5$ and $P_4O_{10}$.

Examples of the aforementioned iron phosphate compounds include:

Iron phosphate compounds: $Fe^{III}(PO_4).nH_2O$, $Fe^{III}{}_2(HPO_4)_3.nH_2O$, $Fe^{III}(H_2PO_4)_3.nH_2O$, $Fe^{II}{}_3(PO_4)_2.nH_2O$, $Fe^{II}(HPO_4).nH_2O$, $Fe^{II}(H_2PO_4)_2.nH_2O$, $Fe^{III}(HPO_4)(OH).nH_2O$, and $Fe^{III}{}_4\{(PO_4)(OH)\}_3.nH_2O$, (n: an integer of at least 0).

Phosphorus oxide and iron phosphate compounds are reduced under almost the same reducing conditions.

In the invention, occurrence of non-galvanized defects is prevented by thermodynamically accurately controlling the reducing conditions of P-based oxide film.

More particularly, the prevent inventors investigated the heating-reduction temperature and the reducing atmosphere giving a satisfactory galvanizability by using various steel sheets having different P contents in steel.

As a result, possibility was found to conduct operation under accurate galvanizing conditions while preventing occurrence of non-galvanized defects by reducing the P-based oxide film under conditions for thermodynamical reduction of the P-based oxide film, and preventing reconcentration of easily oxidizable elements such as Mn resulting from a very high heating-reduction temperature.

Further, according to the result of this investigation, operation can be conducted under accurate galvanizing conditions while reducing the P-based oxide film, preventing reconcentration of Mn on the surface caused by a high heating-reduction temperature, and thus preventing occurrence of non-galvanized defects, by causing the heating temperature: $t_1$ (° C.) in heating-reduction during hot-dip galvanizing to satisfy the following equation (1) relative to the P content in steel: P (wt. %):

$$0.9 \leqq \{[P(\text{wt. }\%)+(2/3)]\times 1100\}/\{t_1(^\circ\text{ C.})\} \leqq 1.1 \quad (1)$$

More specifically, in a steel sheet containing up to 0.1 wt. % P of the invention, when the P content in steel is high, it is necessary to increase the heating-reduction temperature accordingly.

However, when the content of easily oxidizable elements in steel is high as in the case of an Mn content in steel of at least 1.0 wt. %, and if the relationship between the heating temperature: $t_1$ (° C.) in heating reduction and the P content in steel: P (wt. %) satisfies the following equation (1-1), easily oxidizable elements such as Mn are concentrated again on the surface during heating reduction, thus causing occurrence of non-galvanized defects due to surface concentrates.

$$\{[P(\text{wt. }\%)+(2/3)]\times 1100\}/\{(t_1(^\circ\text{ C.})\} < 0.9 \quad (1\text{-}1)$$

When the relationship between the heating temperature: $t_1$ (° C.) in heating-reduction and the P content in steel: P (wt. %) satisfies the following equation (1-2), reduction of the P-based oxide film becomes insufficient, thus making it impossible to prevent occurrence of non-galvanized defects:

$$1.1 < \{[P(\text{wt. }\%)+(2/3)]\times 1100\}/\{(t_1(^\circ\text{ C.})\} \quad (1\text{-}2)$$

In actual operation, occurrence of non-galvanized defects can be prevented if the heating-reduction temperature is within upper and lower limits of ±10% of the aforementioned optimum heating-reduction temperature.

For the heating-reduction atmosphere, it is necessary to select appropriate dew point and hydrogen concentration by means of an Ellingham diagram to specify a region in which the P-based oxide film can be reduced. However, because the reduction reaction is a function of the atmosphere and the soaking time during heating-reduction, it is desirable in an actual operation that the dew point is slightly lower, and the hydrogen concentration is slightly higher than ranges thermodynamically required.

For this purpose, for the atmosphere gas during heating-reduction prior to hot-dip galvanizing, the dew point should preferably be within a range of from −50° C. to 0° C., and the hydrogen concentration, from 1 to 100 vol. %.

When the dew point of the atmosphere gas during heating-reduction is over 0° C., it is difficult to reduce the P-based oxide film, requiring a longer period of time for heating-reduction.

It is industrially difficult to achieve a dew point of the atmosphere of under −50° C. The dew point should therefore be within a range of from −50° C. to 0° C.

A hydrogen concentration lower than 1 vol. % makes it difficult to reduce the P-based oxide film, thus requiring a longer period of time for heating-reduction.

The hydrogen concentration of the atmosphere gas during heating-reduction conducted prior to hot-dip galvanizing should be within a range of from 1 to 100 vol. %.

In the invention, as described above, occurrence of non-galvanized defects is prevented by controlling the dew point and the hydrogen concentration of the atmosphere gas and the heating temperature (steel sheet temperature) upon heating-reduction so as to permit reduction of the P-based oxide film caused by the P content in steel with the reducing atmosphere, and when much easily oxidizable elements such as Mn an contained, inhibiting the amount of surface concentrates so as to avoid an excessive increase in the annealing temperature.

II-3: Manufacturing conditions for single-stage heating (:heating-reduction→hot-dip galvanizing)

In the present invention, a steel slab comprising the aforementioned chemical composition is hot-rolled by the conventional method, and the resultant hot-rolled steel sheet is coiled at a temperature of up to 750° C.

Then, the resultant hot-rolled steel sheet is pickled to eliminate scale.

The steel sheet thus obtained is pickled, heated, directly or after cold-rolling, in an atmosphere gas in which the heating temperature: T is within a range of from 750 to 1,000° C. and satisfies the following equation (2), the dew point of the atmosphere gas: t satisfies the following equation (3) and the hydrogen concentration is within a range of from 1 to 100 vol. %, and then hot-dip galvanized:

$$0.85 \leqq \{[P(\text{wt. }\%)+(2/3)]\times 1150\}/\{T(^\circ\text{ C.})\} \leqq 1.15 \quad (2)$$

$$0.35 \leqq \{[P(\text{wt. }\%)+(2/3)]\times(-30)\}/\{t(^\circ\text{ C.})\} \leqq 1.8 \quad (3)$$

With an annealing temperature of under 750° C., C and M concentrated in band-shaped secondary phase (mainly comprising cementite, pearlite and bainite, and very partially martensite and residual austenite) cannot be dispersed, resulting in occurrence of non-galvanized defects. The heating temperature should therefore be at least 750° C.

When the heating temperature is over 1,000° C., at which the steel comes off the $\alpha$–$\gamma$ dual phase region, desired structure and material quality are unavailable.

Along with the increase in the P content in steel, it is necessary to increase the heating temperature as in the above-mentioned equation (2) for the following reasons.

Fe-P-based pickling residues in the form of P-based oxides are produced with elution of the substrate metal on the steel sheet surface upon scale pickling of the hot-rolled steel sheet. It is therefore necessary, in order to improve galvanizability, to completely reduce the residues, and increase temperature.

The amount of produced P-based oxides is substantially in proportion to the P content in steel.

Along with the increase in the P content in steel, the heating temperature must be increased as in the above-mentioned equation (2).

A higher heating temperature causes an increase in the amount of surface concentrates of easily oxidizable alloying elements for solid-solution hardening of Mn and the like and resultant deterioration of galvanizability. It is therefore necessary to thermodynamically inhibit the surface concentration by reducing the dew point of the atmosphere gas upon heating.

The dew point of the atmosphere gas upon heating should be reduced as shown by the above-mentioned equation (3) along with the increase in the P content in steel.

Further, when the hydrogen concentration in the atmosphere gas upon heating is under 1 vol. %, the P-based oxides are hard to be thermodynamically reduced, and this not desirable because it requires a longer period of heating.

The hydrogen concentration in the atmosphere gas upon heating should therefore be within a range of 1 to 100 vol. %.

It is possible to achieve satisfactory galvanizability and coating adhesion, irrespective of addition or not of Mo, by heating the steel sheet under conditions including a strictly controlled heating atmosphere on the hot-dip galvanizing line, without heating previously in the annealing furnace as described above, and then subjecting the steel sheet to hot-dip galvanizing.

Satisfactory galvanizability and coating adhesion can be maintained only by simultaneously controlling the heating temperature (steel sheet temperature), the dew point and the hydrogen concentration of the atmosphere gas so as to simultaneously satisfy requirements for the reduction of Fe-P-based pickling residues upon heating and inhibition of surface concentration of steel constituents as described above.

According to the invention, therefore, it is possible to ensure satisfactory galvanizability and coating adhesion even without the annealing step before the hot-dip galvanizing line.

II-4: Manufacturing conditions of hot-dip galvanizing and galvannealing treatment In the invention, hot-dip galvanizing is applied in the hot-dip galvanizing bath after heat-reduction of the steel substrate as described above.

The hot-dip galvanizing bath is appropriately a galvanizing bath containing from 0.08 to 0.2 wt. % Al, and the bath temperature should preferably be within a range of from 460 to 500° C.

The steel sheet temperature upon entering the bath should preferably be within a range of from 460 to 500° C.

The coating weight of the hot-dip galvanized steel sheet should preferably be within a range of from 20 to 120 g/m$^2$ as the weight per side of the steel sheet.

A coating weight of hot-dip galvanizing of under 20 g/m$^2$ leads to a decrease in corrosion resistance. A coating weight of over 120 g/m$^2$ results, on the other hand, in practical saturation of the corrosion resistance improving effect, and this is economically disadvantageous.

The term the coating weight per side of steel sheet means the coating weight per unit area calculated by dividing the coating weight of galvanizing by the coating area.

That is, in the case of ordinary two-side galvanizing, this term means the coating weight per unit area obtained by dividing the galvanizing coating weight by the galvanizing area on the both sides, and in the case of one-side galvanizing, means the coating weight per unit area obtained by dividing the galvanizing coating weight by the galvanizing area on the single side.

The present inventors carried out extensive studies on conditions for improving coating adhesion after galvannealing upon the hot-dip galvanized steel sheet manufactured as described above. The result reveals that, when the galvannealing temperature: $t_2$ (° C.) satisfies the following equation (4) in response to the P content in steel: P (wt. %) and the bath Al content: Al (wt. %) upon hot-dip galvanizing, galvannealing proceeds satisfactorily, and deterioration of coating adhesion caused by over-galvannealing can be inhibited.

$$0.95 \leqq [7\times\{100\times[P(\text{wt. }\%)+(2/3)]+10\times Al\ (\text{wt. }\%)\}]/[t_2(^\circ\ C.)] \leqq 1.05 \quad (4)$$

In other words, since P in steel segregates on grain boundaries of the steel substrate and causes a delay in the galvannealing reaction. When steel contains much P, therefore, the galvannealing reaction does not proceed unless the galvannealing temperature is increase.

With a low P content in steel, a very high galvannealing temperature causes deterioration of coating adhesion as a result of over-galvannealing.

Further, when the hot-dip galvanizing bath contains much Al, a large quantity of Fe-Al alloy layer occurs immediately after galvanizing, requiring a high temperature for galvannealing.

When the Al content in the bath is low, deterioration of coating adhesion may be caused by over-galvannealing unless galvannealing temperature is inhibited.

As described above, in order to ensure a satisfactory coating adhesion, the galvannealing treatment must be carried out by determining the galvannealing temperature: $t_2$ (° C.) in response to the P content in steel: P (wt. %) and the bath Al content upon hot-dip-galvanizing: Al (wt. %).

In the invention, the galvannealing treatment should preferably be conducted so that the galvannealing temperature: $t_2$ (° C.) satisfies the following equation (4) relative to the P content in steel: P (wt. %) and the bath Al content: Al (wt. %) upon hot-dip galvanizing:

$$0.95 \leqq [7\times\{100\times[P(\text{wt. }\%)+(2/3)]+10\times Al(\text{wt. }\%)\}]/[t_2(^\circ\ C.)] \leqq 1.05 \quad (4)$$

A galvannealing temperature: $t_2$ (° C.) satisfying the following equation (4-1) is not suitable because over-galvannealing causes deterioration of coating adhesion:

$$[7\times\{100\times[P(\text{wt. }\%)+(2/3)]+10\times Al(\text{wt. }\%)\}]/[t_2(^\circ\ C.)]<0.95 \quad (4\text{-}1)$$

A galvannealing temperature: $t_2$ (° C.) satisfying the following equation (4-2) is not suitable since insufficient galvannealing causes low-galvannealed defect, or a longer period required for galvannealing is disadvantageous in terms of productivity.

$$1.05<[7\times\{100\times[P(\text{wt. }\%)+(2/3)]+10\times Al(\text{wt. }\%)\}]/[t_2(^\circ\ C.)] \quad (4\text{-}2)$$

As described above, the galvannealing treatment in the invention is characterized in that an optimum coating adhesion is ensured by controlling the galvannealing temperature after hot-dip galvanizing in response to the P content in steel substrate and the bath Al content during hot-dip galvanizing.

In an actual operation, a satisfactory coating adhesion can be maintained if the galvannealing temperature is within the upper and lower limits of the above-mentioned optimum galvannealing temperature ±5%.

The amount of Fe diffusion into the galvanizing layer during the galvannealing treatment as described above must be within a range of from 8 to 11 wt. % of the Fe content in the resultant galvanizing layer.

An Fe content of under 8 wt. % not only causes occurrence of low-galvannealed defect, but also causes deterioration of the coefficient of friction resulting from insufficient galvannealing. With an Fe content of over 11 wt. %, over-galvannealing causes deterioration of coating adhesion.

In the invention, the Fe content in the galvanizing layer after galvannealing should preferably be within a range of from 9 to 10 wt. %.

Addition of Mo to the substrate steel sheet improves, on the other hand, coating adhesion. In addition, corrosion resistance was found to be improved when the amount of Mo diffusion into the galvanizing layer during galvannealing of the hot-dip galvanized steel sheet made from the substrate added with Mo satisfied the range of from 0.002 to 0.11 wt. % as measured as the Mo content in the resultant galvanizing layer.

The reason is that Mo is hard to be oxidized than Fe, and only a slight diffusion of Mo into the galvanizing layer or addition there of can bring about an improvement of corrosion resistance.

In the invention, the amount of Mo diffusion into the galvanizing layer upon galvannealing, as represented by the Mo content in the resultant galvanizing layer should preferably be within a range of from 0.002 to 0.11 wt. %.

With an amount of Mo diffusion of under 0.002 wt. % the corrosion resistance improving effect is insufficient. With an amount of over 0.11 wt. %, on the other hand, in order to maintain an Mo content in the galvanizing layer of over 0.11 wt. %, the Mo content in the substrate steel sheet must be over 1.0 wt. %, and this is undesirable from economic considerations.

If the P-based oxide film is not as yet reduced upon heating-reduction immediately prior to galvanizing, diffusion of Mo into the galvanizing layer tended to be inhibited.

Complete reduction of the P-based oxide film during heating-reduction has an effect of improving coating adhesion. In an Mo-added steel sheet, apart from this effect, there is available an effect of accelerating diffusion of Mo into the galvanizing layer by the reduction of the P-based oxide film, and as a result, availability was revealed an effect of improving corrosion resistance of the galvannealed steel sheet.

According to the invention, as described above, the galvannealed steel sheet obtained by galvannealing a steel sheet containing up to 1.00 wt. % Mo after hot-dip galvanizing, having, in the galvannealing layer, an Fe content within a range of from 8 to 11 wt. %, and an Mo content within a range of from 0.002 to 0.11 wt. % was revealed to be a high strength galvannealed steel sheet excellent both in coating adhesion and corrosion resistance.

The aforementioned steel sheet containing up to 1.00 wt. % Mo should have an Mo content within a range of from 0.01 to 1.00 wt. %, or preferably, from 0.05 to 1.00 wt. %, or more preferably, from 0.05 to 0.5 wt. %.

In the invention, the coating weight of the galvannealed steel sheet should preferably be within a range of from 20 to 120 g/m$^2$ as represented by the coating weight per side of steel sheet.

A coating weight of the galvannealed steel sheet of under 20 g/m$^2$ leads to a decrease in corrosion resistance. A coating weight of over 120 g/m$^2$ results, on the other hand, in practical saturation of the corrosion resistance improving effect, and is not therefore economical.

The layer of the aforementioned coating weight of galvannealing which represents a metal diffusion layer is soluble in an alkali-containing solution of NaOH or KOH, or, in an acid-containing solution of HCl or $H_2SO_4$. It is therefore possible to measure the coating weight by analyzing the resultant solution.

EXAMPLES

The present invention will now be described in detail by means of examples.

Example 1

(Examples 1–20, comparative Examples 1–12)

[Dispersion of Band Structures in Steel Sheet]

A continuously cast slab having a chemical composition (kinds of steel A to Q) shown in Table 1 and a thickness of 300 mm was heated to 1,200° C., roughly rolled through two passes, and then coiled in the form of a hot-rolled steel sheet having a thickness of 2.3 mm on a 7-stand finishing mill.

After pickling, the hot-rolled steel sheet thus obtained was heated directly for Experiments Nos. 1, 9, 11, 12, 17, 19, 20, 27, 28 and 29, and heated after cold rolling to a thickness of 1.0 mm for Experiments Nos. 2–8, 10, 13–16, 18, 21–26 and 30–32, on a continuous annealing line (first run of heating). On a continuous hot-dip galvanizing line, the steel sheet was pickled, heated (first or second run of heating) and the galvanized, and as required subjected further to a galvannealing treatment.

For some of the kinds of steel C to E, the 1.0 mm-thick cold-rolled steel sheet was heated on the continuous annealing line to subjected to electrogalvanizing, in addition to the above.

Manufacturing conditions in the individual cases are shown in Tables 2 and 3.

Using the thus obtained steel sheets as samples, mechanical properties, galvanizability, galvannealing-treatability and spot weldability were investigated.

The ratio of the thickness Tb of the band structure comprising the secondary phase to the sheet thickness, Tb/T, was measured through observation of steel sheet structures after heating (first run of heating) on the continuous annealing line or the continuous hot-dip galvanizing line.

The thickness of the band structure Tb was determined by measuring thickness of all band structures comprising the secondary phase in the thickness direction of steel sheet on an image of 1,500 magnification by means of an image analyzer, and calculating in accordance with the following equation (5):

$$\text{Band structure thickness: } Tb=\Sigma Tbi/n \quad (5)$$

where, ΣTbi: total of thickness of band structures in the thickness direction of steel sheet;

n: number of band structures in the thickness direction of steel sheet.

Galvanizability, galvannealing-treatability and spot weldability were evaluated by the following methods:

[Galvanizability]

Complete absence of non-galvanized defects was marked "Excellent", presence of slight non-galvanized defects, "Good", and serious non-galvanized defects, "Poor", and the samples were visually inspected.

[Galvannealing-treatability]

Complete absence of galvannealing blurs was marked "Excellent", presence of slight galvannealing blurs, "Good", and serious galvannealing blurs, "Poor", and the samples were visually inspected.

[Spot weldability]

In compliance with the method of JIS Z3136, a tensile-shearing test of spot-welded joint was carried out: a lower limit of tensile-shearing strength of 6,700 N was set for a thickness of 1.0 mm, and 23,000 N for a thickness of 2.3 mm. A sample showing a strength of at least the lower limit strength was marked "Excellent" and a sample having a strength of under the lower limit, "Poor".

The results of measurement are comprehensively shown in Table 2 and 3.

Table 1 to 3 suggest that Examples 1 to 20 have a low yield ratio, a good TS×El value and no problem is posed for galvanizability, galvannealing-treatability.

Example 2

(Examples 21–37, Comparative Examples 13–21)

[Two-stage Heating-pickling]

A 300 mm-thick continuously cast slab having a chemical composition shown in Table 1 (kinds of steel: A-D, DD, F-I, K-N, R-X) was heated to 1,200° C., roughly rolled through three passes, and rolled on a 7-stand finishing mill into a hot-rolled steel sheet having a thickness of 2.3 mm.

The hot-rolled steel sheet was then coiled at a temperature (CM) shown in Tables 4 and 5.

After pickling, the resultant steel sheet was passed through a continuous annealing line in an as-hot-rolled state for Experiments Nos. 33, 43–49, and 52–54, and for Experiments Nos. 34–42, 50, 61 and 55–58, the sheet was cold-rolled into a thickness of 1.0 mm, then threaded into the continuous annealing line, and annealed at a heating temperature shown in Tables 4 and 5.

Subsequently, the rolled steel sheets of various kinds of steel thus obtained were sent to a continuous hot-dip galvanizing line, and subjected to pickling, heating-reduction, hot-dip galvanizing and galvannealing (Examples 21–23 and 25–37, Comparative Examples 13–21).

In Example 24, a galvannealing treatment was not applied. In compliance with the methods of evaluation and evaluation criteria described later, properties of the resultant hot-dip galvanized steel sheets were evaluated.

Manufacturing conditions other than those shown in Tables 4 and 5 are mentioned in (1) to (3) below.

(1) Pickling on Continuous Hot-dip Galvanizing Line

Experiments on pickling on the continuous hot-dip galvanizing line shown in Tables 4 and 5 were carried out under the following conditions: liquid temperature: 60° C., HCl concentration: 5 wt. % pickling solution (pH=up to 1), or liquid temperature: 60° C., $H_2SO_4$ concentration: 5 wt. % pickling solution (pH=up to 1). Pickling was applied for 10 seconds. Effect of improving galvanizability was observed in the both cases.

(2) Heating-reduction on Continuous Hot-dip Galvanizing Line:

Heating-reduction on the continuous hot-dip galvanizing line shown in Table 4 and 5 was carried out in a $H_2$—$N_2$ gas atmosphere having $H_2$ concentration shown in Tables 4 and 5.

(3) Coating Weight of Hot-dip Galvanizing and Coating Weight of Galvannealing

For Example 24 in which no galvannealing treatment was applied, the coating weight of hot-dip galvanizing was 40 g/m$^2$ for the both sides of the steel sheet.

The coating weight for galvannealing was within a range of from 30 to 60 g/m$^2$ for the both sides of the steel sheet (Examples 21–23, 25–37, and Comparative Examples 13–21).

Then, for the hot-dip galvanized steel sheets thus obtained, galvanizability, coating adhesion, exterior view after galvannealing, degree of galvannealing, corrosion resistance, workability and spot weldability of galvannealed steel sheet were evaluated in accordance with the following methods of evaluation and the criteria for evaluation.

The results of evaluation are shown in Table 6 and 7.

Reduction or not of P-based oxides in Tables 4 and 5 was judged by analyzing the steel sheet surface by an ESCA (photoelectron spectroscope) and seeing whether or not peaks of P compounds considered to be combined with oxygen are clearly recognizable.

The above-mentioned P compounds considered to be combined with oxygen include the following iron phosphate compounds mainly comprising phosphate ion ($PO_4^{3-}$), hydrophosphate ion, dihydrophosphate ion ($HPO_4^{2-}$, $H_2PO_4^-$), hydroxyl group ($OH^-$) and iron ion ($Fe^{3+}$, $Fe^{2+}$):

Iron phosphate compounds: $Fe^{III}(PO_4).nH_2O$, $Fe^{III}{}_2(HPO_4)_3.nH_2O$, $Fe^{III}(H_2PO_4)_3.nH_2O$, $Fe^{II}{}_3(PO_4)_2.nH_2O$, $Fe^{II}(HPO_4).nH_2O$, $Fe^{II}(H_2PO_4)_2.nH_2O$, $Fe^{III}(HPO_4)(OH).nH_2O$, and $Fe^{III}{}_4\{(PO_4)(OH)\}_3.nH_2O$ (n: an integer of at least 0).

ESCA was measured by the common method. Paying attention to the spectral intensity of P at the position considered to combine with O, corresponding to any of the iron phosphate compounds listed above, shown as examples of actual measurement in ordinary table of spectra, a peak was deemed to be clearly recognizable when the height H from the peak position base as compared with the average amplitude N of noise portions other than the peaks satisfies the relationship $H \geqq 3N$.

[Galvanizability]

The exterior view of the galvanized steel sheet after hot-dip galvanizing (hot-dip galvanized steel sheet not as yet galvannealed) was visually evaluated.

○: No non-galvanized defects (good galvanizability)

X: Occurrence of non-galvanized defects

[Coating Adhesion]

After bending and straightening the galvanized steel sheet by 90°, the galvanizing layer on the compression side was peeled off with a cellophane tape, and coating adhesion was evaluated from the amount of galvanizing film adhering to the cellophane tape.

(Galvanized Steel Sheet not as Yet Galvannealed)

○: No peeling of galvanizing layer (good coating adhesion)

X: Peeling of galvanizing layer present (poor coating adhesion)

(Galvanized and Galvannealed Steel Sheet)

○: Small amount of peeling of galvanizing layer (good coating adhesion)

X : Much peeling of galvanizing layer (poor coating adhesion)

[Exterior View After Galvannealing]

The exterior view after galvannealing was visually evaluated.

○: Uniform exterior view free from galvannealing blurs obtained

X: Galvannealing blurs occur

[Degree of Galvannealing, Amount of Mo Diffusion]

The galvanizing layer was dissolved by a common galvanizing layer dissolving method using an alkaline solution or an acid solution, and by analyzing the resultant solution the Fe content and the Mo content in the galvannealed layer were analyzed and measured.

[Workability]

Samples satisfying $TS \geqq 590$ MPa, $El \geqq 30\%$ were marked good, and others poor.

[Corrosion Resistance]

Corrosion resistance was evaluated from weight loss by corrosion in a salt spray test (SST).

Presence of corrosion resistance improving effect was evaluated through comparison with the galvannealed steel sheet using a steel sheet not added with Mo as the substrate.

[Spot Weldability]

Direct spot welding was carried out under conditions including a pressing force of 2.01 kN, current: 3.5 kA, an energizing time: Ts=25 cyc., Tup=3 cyc., Tw=8 cyc., Th=5 cyc., To=50 cyc., and a spherical chip shape having a diameter of DR6. Samples which could be welded were marked excellent, and those which could not be welded were marked poor.

As shown in Tables 6 and 7, the galvannealed steel sheets of Examples 21 to 23 and Examples 25 to 37 manufactured by the manufacturing method of the invention are all free from non-galvanized defects, are excellent in galvanizability, and have no problem in coating adhesion, exterior view after galvannealing, workability and spot weldability.

For the hot-dip galvanized steel sheet of Example 24 also, no non-galvanized defects occurred, with an excellent galvanizability, and there was no problem in coating adhesion, workability and spot weldability.

In contrast, the galvannealed steel sheets of Comparative Examples 13 to 21 were manufactured under conditions different from those of the invention in the heating-reduction temperature before hot-dip galvanizing, the temperature during galvannealing after hot-dip galvanizing, the degree of galvannealing or the chemical composition of steel. These samples suffered from occurrence of non-galvanized defects, or were poor in galvanizing quality or in workability.

Further, the galvannealed steel sheet using a substrate steel sheet not containing added Mo (Comparative Example 14) was hard to reduce P-based oxides and was poor in mechanical properties (workability) as well as in galvanizability and coating adhesion.

Regarding corrosion resistance, the weight loss by corrosion is smaller in the steel sheet containing Mo in the galvanizing layer than the steel sheets not containing Mo in the galvanizing layer, or having only a slight contact of Mo (Comparative Examples 13 and 14), thus suggesting that diffusion, addition of Mo into the galvanizing layer brings about a corrosion inhibiting effect.

Example 3

(Examples 38–46, Comparative Example 22)

[Single-heating Treatment]

Various cold-rolled steel sheets of different kinds of steel were passed through the continuous hot-dip galvanizing line and subjected to heating-reduction, hot-dip galvanizing, and galvannealing treatment in the same manner as in the aforementioned Examples 21 to 23 and 25 to 37 except that annealing before passing to the continuous hot-dip galvanizing line and pickling on the continuous hot-dip galvanizing line were omitted, and the resultant hot-dip galvanized steel sheets (not-yet-galvannealed hot-dip galvanized steel sheets) and galvannealed steel sheets were subjected to evaluation in the same manner as in Examples 21 to 23 and 25 to 37.

The manufacturing conditions are shown in Table 8, and the result obtained, in Table 9.

The coating weight of the galvannealing layer was within a range of from 30 to 60 g/m$^2$ for both sides of the steel sheet in all cases.

As shown in Tables 8 and 9, it is now possible to prevent occurrence of non-galvanized defects in the hot-dip galvanized steel sheet and to manufacture a galvannealed steel sheet excellent in coating adhesion, exterior view after galvannealing and workability by using a heating temperature, a dew point and a hydrogen concentration of the atmosphere gas upon heating-reduction on the continuous hot-dip galvanizing line (Examples 38–46).

When the above-mentioned conditions do not satisfy the ranges of the invention, in contrast, non-galvanized defects were produced (Comparative Example 22).

Industrial Applicability

According to the present invention, as described above, it is now possible to provide a high strength thin steel sheet free from galvanizability problem, low in yield ratio, and having a good TS×El value.

Further, according to the invention, it is possible to provide a high strength hot-dip galvanized steel sheet and a high strength galvannealed steel sheet permitting prevention of occurrence of non-galvanized defects, excellent in coating adhesion and in corrosion resistance.

As a result, it is possible to reduce weight of automobiles and reduce fuel consumption, and in the long run to largely contribute to improvement of environments on the earth by applying the high strength thin steel sheet and the galvanized steel sheet of the invention.

TABLE 1

| Kind Of | Chemical Composition (wt. %) | | | | | | | | | | | | |
|---|---|---|---|---|---|---|---|---|---|---|---|---|---|
| Steel | C | Si | Mn | P | S | Al | N | Mo | Cr | Ti | Nb | V | Remarks |
| A | 0.086 | 0.01 | 1.8 | 0.012 | 0.004 | 0.047 | 0.0025 | 0.15 | 0.02 | — | — | — | Steel Within Scope |
| B | 0.115 | 0.04 | 2.2 | 0.008 | 0.002 | 0.054 | 0.0031 | 0.21 | — | 0.02 | — | 0.02 | Steel Within Scope |
| C | 0.068 | 0.02 | 1.6 | 0.011 | 0.003 | 0.042 | 0.0024 | 0.13 | — | — | — | — | Steel Within Scope |
| D | 0.057 | 0.03 | 2.6 | 0.021 | 0.001 | 0.038 | 0.0031 | 0.09 | — | — | — | — | Steel Within Scope |
| E | 0.059 | 0.03 | 2.3 | 0.018 | 0.007 | 0.035 | 0.0028 | 0.11 | 0.01 | — | 0.01 | — | Steel Within Scope |
| F | 0.042 | 0.02 | 2.1 | 0.014 | 0.002 | 0.038 | 0.0024 | 0.17 | — | — | — | — | Steel Within Scope |
| G | 0.077 | 0.01 | 1.6 | 0.007 | 0.001 | 0.033 | 0.0026 | 0.19 | — | — | — | 0.035 | Steel Within Scope |
| H | 0.069 | 0.01 | 1.6 | 0.008 | 0.002 | 0.035 | 0.0028 | 0.18 | — | — | — | — | Steel Within Scope |
| I | 0.035 | 0.02 | 1.5 | 0.011 | 0.003 | 0.041 | 0.0024 | 0.19 | 0.02 | 0.05 | — | — | Steel Within Scope |
| J | 0.153 | 0.05 | 1.6 | 0.012 | 0.004 | 0.045 | 0.0032 | 0.17 | 0.03 | 0.11 | — | 0.02 | Steel Within Scope |
| K | 0.075 | 0.01 | 1.2 | 0.009 | 0.003 | 0.037 | 0.0031 | 0 * | 0.02 | 0.064 | 0.02 | — | Steel Within Scope |
| L | 0.008 | 0.01 | 1.5 | 0.007 | 0.006 | 0.041 | 0.0027 | 0.09 | 0.03 | — | — | — | Comparative Steel |
| M | 0.068 | 0.02 | 0.8 | 0.015 | 0.005 | 0.034 | 0.0025 | 0.25 | 0.02 | — | — | — | Comparative Steel |
| N | 0.089 | 0.04 | 1.6 | 0.123 | 0.004 | 0.056 | 0.0033 | 0.11 | 0.02 | — | — | — | Comparative Steel |
| O | 0.072 | 0.35 | 2.0 | 0.005 | 0.003 | 0.031 | 0.0034 | 0.10 | 0.31 | — | — | — | Steel Within Scope |
| P | 0.096 | 0.46 | 1.9 | 0.007 | 0.005 | 0.047 | 0.0029 | 0.05 | 0.21 | 0.01 | — | — | Steel Within Scope |
| Q | 0.060 | 0.21 | 1.5 | 0.013 | 0.007 | 0.061 | 0.0025 | 0.03 | 0.50 | — | 0.01 | 0.01 | Steel Within Scope |
| R | 0.076 | 0.01 | 1.85 | 0.041 | 0.004 | 0.042 | 0.0025 | 0.05 | — | — | — | — | Steel Within Scope |
| S | 0.066 | 0.01 | 1.81 | 0.069 | 0.003 | 0.039 | 0.0021 | 0.05 | — | — | — | — | Steel Within Scope |
| T | 0.065 | 0.01 | 1.83 | 0.071 | 0.004 | 0.041 | 0.0019 | 0.05 | 0.1 | — | — | — | Steel Within Scope |
| U | 0.081 | 0.01 | 1.69 | 0.072 | 0.004 | 0.039 | 0.0015 | 0.05 | — | 0.05 | — | — | Steel Within Scope |
| V | 0.074 | 0.01 | 2.2 | 0.066 | 0.003 | 0.038 | 0.0024 | 0.05 | — | — | 0.05 | — | Steel Within Scope |
| W | 0.077 | 0.01 | 1.9 | 0.067 | 0.003 | 0.036 | 0.0016 | 0.05 | — | — | — | 0.05 | Steel Within Scope |
| X | 0.091 | 0.01 | 1.85 | 0.093 | 0.003 | 0.038 | 0.0018 | 0.05 | — | — | — | — | Steel Within Scope |
| DD | 0.057 | 0.03 | 2.6 | 0.021 | 0.001 | 0.038 | 0.0031 | 0.03 | — | — | — | — | Steel Within Scope |

Remarks) *: Mo not added

TABLE 2

| Experiment No. | Kind of Steel | Coiling Tempe. (° C.) | Presence of Cold Rolling Step | First Heating Temp. (° C.) | Kind of Plating | Second Heating Temp. (° C.) | Tb/T | YS (MPa) | TS (MPa) | EI (%) | YEI (%) | YR (%) | TS*EI (MPa %) |
|---|---|---|---|---|---|---|---|---|---|---|---|---|---|
| 1 | A | 620 | Absent | 850 | Hot-Dip | 750 | 0.003 | 351 | 602 | 32 | 0.0 | 58 | 19264 |
| 2 | A | 670 | Present | 850 | Hot-Dip | — | 0.001 | 376 | 600 | 29 | 0.0 | 63 | 17400 |
| 3 | B | 650 | Present | 850 | Hot-Dip | 750 | 0.003 | 371 | 621 | 30 | 0.0 | 60 | 18630 |
| 4 | B | 630 | Present | 720 | Hot-Dip | 700 | 0.008 | 402 | 557 | 24 | 1.5 | 72 | 13368 |
| 5 | B | 600 | Present | 830 | — | — | 0.002 | 356 | 653 | 31 | 0.0 | 55 | 20243 |
| 6 | C | 500 | Present | 850 | Hot-Dip | 750 | 0.001 | 332 | 595 | 31 | 0.0 | 56 | 18445 |
| 7 | C | 500 | Present | 850 | Electr. | — | 0.001 | 355 | 678 | 29 | 0.0 | 52 | 19662 |
| 8 | D | 670 | Present | 850 | Hot-Dip | 750 | 0.004 | 321 | 590 | 32 | 0.0 | 54 | 18880 |
| 9 | D | 500 | Absent | 700 | Hot-Dip | — | 0.006 | 378 | 540 | 26 | 2.0 | 70 | 14040 |
| 10 | D | 500 | Present | 700 | Electr. | — | 0.006 | 347 | 668 | 28 | 0.0 | 52 | 18704 |
| 11 | E | 600 | Absent | 775 | Hot-Dip | 750 | 0.007 | 421 | 554 | 28 | 1.2 | 76 | 15512 |
| 12 | E | 600 | Absent | 775 | Electr. | — | 0.007 | 445 | 569 | 25 | 1.5 | 78 | 14225 |
| 13 | E | 600 | Present | 700 | Hot-Dip | — | 0.005 | 431 | 571 | 30 | 0.5 | 75 | 17130 |
| 14 | F | 630 | Present | 840 | Hot-Dip | 750 | 0.003 | 332 | 593 | 31 | 0.0 | 56 | 18383 |
| 15 | F | 600 | Present | 800 | Hot-Dip | — | 0.003 | 329 | 600 | 31 | 0.0 | 55 | 18600 |
| 16 | F | 600 | Present | 700 | Hot-Dip | 700 | 0.006 | 376 | 556 | 26 | 1.5 | 67 | 14508 |
| 17 | F | 550 | Absent | 700 | Hot-Dip | 700 | 0.008 | 368 | 540 | 28 | 2.0 | 68 | 15120 |

TABLE 2-continued

| Experiment No. | Galvanizability | Galvannealing Property | Spot Weldability | Remarks (process, kind of product *) | Division |
|---|---|---|---|---|---|
| 1 | Excellent | Excellent | Excellent | Hot-CAL-CGL, GA | Example 1 |
| 2 | Good | Good | Excellent | Cold-CGL, GA | Example 2 |
| 3 | Excellent | Excellent | Excellent | Cold-CAL-CGL, GA | Example 3 |
| 4 | Poor | Poor | Excellent | Cold-CAL-CGL, GA | Comparative Example 1 |
| 5 | — | — | Excellent | Cold-CAL, CA | Example 4 |
| 6 | Excellent | Excellent | Excellent | Cold-CAL-CGL, GA | Example 5 |
| 7 | Excellent | — | Excellent | Cold-CAL-EGL, EG | Example 6 |
| 8 | Excellent | Excellent | Excellent | Cold-CAL-CGL, GA | Example 7 |
| 9 | Poor | Poor | Excellent | Hot-CGL, GA | Comparative Example 2 |
| 10 | Excellent | — | Excellent | Cold-CAL-EGL, EG | Example 8 |
| 11 | Excellent | Excellent | Excellent | Hot-CAL-CGL, GA | Comparative Example 3 |
| 12 | Excellent | — | Excellent | Hot-CAL-EGL, EG | Comparative Example 4 |
| 13 | Poor | Poor | Excellent | Cold-CGL, GA | Comparative Example 5 |
| 14 | Excellent | — | Excellent | Cold-CAL-CGL, GI | Example 9 |
| 15 | Good | Good | Excellent | Cold-CGL, GA | Example 10 |
| 16 | Poor | Poor | Excellent | Cold-CAL-CGL, GA | Comparative Example 6 |
| 17 | Poor | Poor | Excellent | Hot-CAL-CGL, GA | Comparative Example 7 |

Remarks) *:
Hot: Hot Rolling,
Cold: Cold Rolling,
CAL: Continuous Anneaiing Line,
CGL: Continuous Hot-Dip Galvanizing Line,
EGL: Electrogalvanizing Line,
GA: Hot-Dip Galvannealed Steel Sheet,
GI: Hot-Dip Galvanized Steel Sheet,
EG: Electrogalvanized Steel Sheet,
CA: Annealed Sheet

TABLE 3

| Experiment No. | Kind of Steel | Coiling Tempe. (° C.) | Presence of Cold Rolling Step | First Heating Temp. (° C.) | Kind of Plating | Second Heating Temp. (° C.) | Tb/T | YS (MPa) | TS (MPa) | EI (%) | YEI (%) | YR (%) | TS*EI (MPa %) |
|---|---|---|---|---|---|---|---|---|---|---|---|---|---|
| 18 | G | 650 | Present | 840 | Hot-Dip | 750 | 0.003 | 334 | 602 | 31 | 0.0 | 55 | 18662 |
| 19 | G | 650 | Absent | 850 | Hot-Dip | — | 0.004 | 348 | 595 | 32 | 0.0 | 58 | 19040 |
| 20 | G | 680 | Absent | 880 | — | — | 0.004 | 339 | 612 | 33 | 0.0 | 55 | 20196 |
| 21 | H | 500 | Present | 840 | Hot-Dip | 750 | 0.001 | 335 | 623 | 30 | 0.0 | 54 | 18690 |
| 22 | H | 600 | Present | 850 | Hot-Dip | — | 0.003 | 355 | 611 | 29 | 0.0 | 58 | 17719 |
| 23 | I | 700 | Present | 820 | Hot-Dip | 750 | 0.002 | 395 | 635 | 28 | 0.0 | 62 | 17780 |
| 24 | I | 650 | Present | 850 | Hot-Dip | — | 0.003 | 401 | 640 | 27 | 0.0 | 63 | 17280 |
| 25 | J | 600 | Present | 750 | Hot-Dip | 750 | 0.006 | 402 | 567 | 26 | 0.0 | 71 | 14742 |
| 26 | K | 650 | Present | 880 | Hot-Dip | 750 | 0.001 | 350 | 550 | 28 | 1.2 | 64 | 15400 |
| 27 | L | 700 | Absent | 850 | Hot-Dip | 750 | 0.001 | 267 | 480 | 32 | 2.3 | 56 | 15360 |
| 28 | M | 650 | Absent | 800 | Hot-Dip | 750 | 0.003 | 280 | 520 | 29 | 2.1 | 54 | 15080 |
| 29 | N | 700 | Absent | 850 | Hot-Dip | 750 | 0.002 | 458 | 635 | 25 | 0.0 | 72 | 15875 |
| 30 | O | 640 | Present | 800 | Hot-Dip | 750 | 0.002 | 412 | 650 | 35 | 0.0 | 63 | 22750 |
| 31 | P | 600 | Present | 850 | Hot-Dip | 750 | 0.003 | 395 | 646 | 36 | 0.0 | 61 | 23256 |
| 32 | Q | 550 | Present | 500 | Hot-Dip | 750 | 0.002 | 380 | 634 | 38 | 0.0 | 60 | 24092 |

| Experiment No. | Galvanizability | Galvannealing Property | Spot Weldability | Remarks (process, kind of product *) | Division |
|---|---|---|---|---|---|
| 18 | Excellent | — | Excellent | Cold-CAL-CGL, GI | Example 11 |
| 19 | Excellent | Excellent | Excellent | Hot-CGL, GA | Example 12 |
| 20 | — | — | Excellent | Hot-CAL, CA | Example 13 |
| 21 | Excellent | Excellent | Excellent | Cold-CAL-CGL, GA | Example 14 |
| 22 | Excellent | Excellent | Excellent | Cold-CGL, GA | Example 15 |
| 23 | Excellent | Excellent | Excellent | Cold-CAL-CGL, GA | Example 16 |
| 24 | Excellent | Excellent | Excellent | Cold-CGL, GA | Example 17 |
| 25 | Excellent | Excellent | Excellent | Cold-CAL-CGL, GA | Comparative Example 8 |
| 26 | Excellent | Excellent | Excellent | Cold-CAL-CGL, GA | Comparative Example 9 |
| 27 | Excellent | Excellent | Excellent | Hot-CAL-CGL, GA | Comparative Example 10 |
| 28 | Excellent | Excellent | Excellent | Hot-CAL-CGL, GA | Comparative Example 11 |
| 29 | Excellent | Excellent | Poor | Hot-CAL-CGL, GA | Comparative Example 12 |
| 30 | Excellent | Excellent | Excellent | Cold-CAL-CGL, GA | Example 18 |
| 31 | Excellent | Excellent | Excellent | Cold-CAL-CGL, GA | Example 19 |
| 32 | Excellent | Excellent | Excellent | Cold-CAL-CGL, GA | Example 20 |

Remarks) *:
Hot: Hot Rolling,
Cold: Cold Rolling,

TABLE 3-continued

CAL: Continuous Anneaiing Line,
CGL: Continuous Hot-Dip Galvanizing Line,
EGL: Electrogalvanizing Line,
GA: Hot-Dip Galvannealed Steel Sheet,
GI: Hot-Dip Galvanized Steel Sheet,
EG: Electrogalvanized Steel Sheet,
CA: Annealed Sheet

TABLE 4

| Experiment No. | Kind of Steel | P Content In Steel (wt. %) | Mo Content In Steel (wt. %) | CT[1] (° C.) | Presence Of Cold Rolling | Heating Temp. In Annealing Furnace (° C.) | Kind Of Acid In Pr-treatment Pickling | Heating-Reduction Temp.[2]: $t_1$ (° C.) | Heating-Reduction Dew Point[3] (° C.) | Heating-Reduction $H_2$ Concentration (vol. %) |
|---|---|---|---|---|---|---|---|---|---|---|
| 33 | A | 0.01 | 0.15 | 620 | Absent | 850 | HCl | 715 | −30 | 5 |
| 34 | B | 0.01 | 0.21 | 650 | Present | 850 | HCl | 750 | −45 | 5 |
| 35 | B | 0.01 | 0.21 | 650 | Present | 850 | $H_2SO_4$ | 750 | −45 | 5 |
| 36 | C | 0.01 | 0.13 | 500 | Present | 850 | HCl | 780 | −25 | 5 |
| 37 | D | 0.02 | 0.09 | 670 | Present | 850 | HCl | 760 | −35 | 4 |
| 38 | DD | 0.02 | 0.03 | 670 | Present | 850 | HCl | 760 | −35 | 7 |
| 39 | F | 0.01 | 0.17 | 630 | Present | 840 | HCl | 770 | −30 | 10 |
| 40 | G | 0.01 | 0.19 | 650 | Present | 840 | HCl | 765 | −30 | 3 |
| 41 | H | 0.01 | 0.18 | 500 | Present | 840 | HCl | 780 | −30 | 20 |
| 42 | I | 0.01 | 0.19 | 700 | Present | 820 | HCl | 750 | −40 | 5 |
| 43 | R | 0.04 | 0.05 | 620 | Absent | 850 | HCl | 715 | −30 | 5 |
| 44 | S | 0.07 | 0.05 | 630 | Absent | 860 | HCl | 750 | −30 | 50 |
| 45 | T | 0.07 | 0.05 | 640 | Absent | 840 | HCl | 780 | −30 | 5 |

| Experiment No. | Reducation Or Not Of P-based Oxides | Al Content In Galvanizing Bath (wt. %) | Galvannealing Temp.: $t_2$[4] (° C.) | X-Value | Y-Value | Division |
|---|---|---|---|---|---|---|
| 33 | Reduced | 0.15 | 480 | 1.04 | 1.01 | Example 21 |
| 34 | Reduced | 0.15 | 470 | 0.99 | 1.03 | Example 22 |
| 35 | Reduced | 0.15 | 470 | 0.99 | 1.03 | Example 23 |
| 36 | Reduced | 0.15 | — | 0.95 | — | Example 24 |
| 37 | Reduced | 0.15 | 500 | 0.99 | 0.98 | Example 25 |
| 38 | Reduced | 0.15 | 500 | 0.99 | 0.98 | Example 26 |
| 39 | Reduced | 0.15 | 480 | 0.97 | 1.01 | Example 27 |
| 40 | Reduced | 0.15 | 495 | 0.97 | 0.98 | Example 28 |
| 41 | Reduced | 0.15 | 480 | 0.95 | 1.01 | Example 29 |
| 42 | Reduced | 0.15 | 470 | 0.99 | 1.03 | Example 30 |
| 43 | Reduced | 0.15 | 485 | 1.09 | 1.04 | Example 31 |
| 44 | Reduced | 0.15 | 505 | 1.08 | 1.04 | Example 32 |
| 45 | Reduced | 0.15 | 510 | 1.04 | 1.03 | Example 33 |

Remarks)
[1]: Coiling temperature after hot-rolling;
[2]: Sheet temperature upon heating-reduction prior to Hot-Dip galvanizing;
[3]: Dew point of atmosphere gas upon heating-reduction prior to Hot-Dip galvanizing;
[4]: Sheet temperature;
X-Value: $\{[P\ (wt.\ \%) + (2/3)] \times 1100\}/\{Heating - Reduction\ Temp.: t_1\ (° C.)\}$
Y-Value: $[7 \times \{100 \times [P\ (wt.\ \%) + (2/3)] + 10 \times Al\ (wt.\ \%)\}]/\{Galvannealing\ Temp.: t_2\ (° C.)\}$

TABLE 5

| Experiment No. | Kind of Steel | P Content In Steel (wt. %) | Mo Content In Steel (wt. %) | CT[1] (° C.) | Presence Of Cold Rolling | Heating Temp. In Annealing Furnace (° C.) | Kind Of Acid In Pr-treatment Pickling | Heating-Reduction Temp.[2]: $t_1$ (° C.) | Heating-Reduction Dew Point[3] (° C.) | Heating-Reduction $H_2$ Concentration (vol. %) |
|---|---|---|---|---|---|---|---|---|---|---|
| 46 | U | 0.07 | 0.05 | 620 | Absent | 850 | HCl | 770 | −30 | 5 |
| 47 | V | 0.07 | 0.05 | 630 | Absent | 860 | HCl | 765 | −30 | 5 |
| 48 | W | 0.07 | 0.05 | 640 | Absent | 840 | HCl | 790 | −30 | 5 |
| 49 | X | 0.09 | 0.05 | 635 | Absent | 850 | HCl | 800 | −30 | 5 |
| 50 | DD | 0.02 | 0.03 | 670 | Present | 850 | HCl | 760 | 20 | 5 |
| 51 | K | 0.01 | 0 | 650 | Present | 880 | HCl | 750 | −40 | 5 |
| 52 | L | 0.01 | 0.09 | 700 | Absent | 850 | HCl | 750 | −35 | 5 |
| 53 | M | 0.02 | 0.25 | 650 | Absent | 800 | HCl | 750 | −30 | 5 |
| 54 | N | 0.12 | 0.11 | 700 | Absent | 860 | HCl | 795 | −30 | 5 |
| 55 | B | 0.01 | 0.21 | 620 | Present | 860 | HCl | 550 | 10 | 0.1 |
| 56 | B | 0.01 | 0.21 | 620 | Present | 850 | HCl | 835 | −30 | 5 |

TABLE 5-continued

| | | | | | | | | | | |
|---|---|---|---|---|---|---|---|---|---|---|
| 57 | B | 0.01 | 0.21 | 620 | Present | 850 | HCl | 770 | −25 | 5 |
| 58 | B | 0.01 | 0.21 | 620 | Present | 850 | HCl | 770 | −25 | 5 |

| Experiment No. | Reducation Or Not Of P-based Oxides | Al Content In Galvanizing Bath (wt. %) | Galvannealing Temp.: $t_2$[4] (° C.) | X-Value | Y-Value | Division |
|---|---|---|---|---|---|---|
| 46 | Reduced | 0.15 | 520 | 1.06 | 1.01 | Example 34 |
| 47 | Reduced | 0.15 | 515 | 1.05 | 1.02 | Example 35 |
| 48 | Reduced | 0.15 | 510 | 1.02 | 1.03 | Example 36 |
| 49 | Reduced | 0.15 | 515 | 1.04 | 1.05 | Example 37 |
| 50 | Not Reduced | 0.15 | 500 | 0.99 | 0.98 | Comparative Example 13 |
| 51 | Not Reduced | 0.15 | 475 | 0.99 | 1.02 | Comparative Example 14 |
| 52 | Reduced | 0.15 | 470 | 0.99 | 1.03 | Ccmparative Example 15 |
| 53 | Reduced | 0.15 | 480 | 1.01 | 1.02 | Comparative Example 16 |
| 54 | Reduced | 0.15 | 545 | 1.09 | 1.03 | Comparative Example 17 |
| 55 | Not Reduced | 0.15 | 490 | 1.35 | 0.99 | Comparative Example 18 |
| 56 | Reduced | 0.15 | 490 | 0.89 | 0.99 | Comparative Example 19 |
| 57 | Reduced | 0.15 | 530 | 0.97 | 0.91 | Comparative Example 20 |
| 58 | Reduced | 0.15 | 450 | 0.97 | 1.08 | Comparative Example 21 |

Remarks)
1): Coiling temperature after hot-rolling;
2): Sheet temperature upon heating-reduction prior to Hot-Dip galvanizing;
3): Dew point of atmosphere gas upon heating-reduction prior to Hot-Dip galvanizing;
4): Sheet temperature;
X-Value: {[P (wt. %) + (2/3)] × 1100}/{Heating - Reduction Temp.: $t_1$ (° C.)}
Y-Value: [7 × {100 × [P (wt. %) + (2/3)] + 10 × Al (wt. %)}]/{Galvannealing Temp.: $t_2$ (° C.)}

TABLE 6

| Experiment No. | Kind of Steel | Galvanizability | Coating Adhesion | Exterior View After Galvannealing | Degree of Galvannealing[1] (wt. %) | Amount Of Mo Diffusion[2] (wt. %) | Workability | Weight Loss By Corrosion ($g/m^2$) | Evaluation Of Corrosion Resistance | Spot Weldability | Remarks | Division |
|---|---|---|---|---|---|---|---|---|---|---|---|---|
| 33 | A | ○ | ○ | ○ | 9.4 | 0.014 | Good | 6 | Good | Excellent | | Example 21 |
| 34 | B | ○ | ○ | ○ | 9.3 | 0.020 | Good | 4 | Good | Excellent | | Example 22 |
| 35 | B | ○ | ○ | ○ | 9.3 | 0.020 | Good | 4 | Good | Excellent | | Example 23 |
| 36 | C | ○ | ○ | — | — | — | Good | 7 | Good | Excellent | Not galvannealed | Example 24 |
| 37 | D | ○ | ○ | ○ | 9.6 | 0.009 | Good | 7.5 | Good | Excellent | | Example 25 |
| 38 | DD | ○ | ○ | ○ | 9.6 | 0.003 | Good | 8 | Good | Excellent | | Example 26 |
| 39 | F | ○ | ○ | ○ | 9.4 | 0.016 | Good | 6 | Good | Excellent | | Example 27 |
| 40 | G | ○ | ○ | ○ | 9.5 | 0.018 | Good | 4 | Good | Excellent | | Example 28 |
| 41 | H | ○ | ○ | ○ | 9.4 | 0.017 | Good | 5 | Good | Excellent | | Example 29 |
| 42 | I | ○ | ○ | ○ | 9.3 | 0.018 | Good | 4 | Good | Excellent | | Example 30 |
| 43 | R | ○ | ○ | ○ | 9.4 | 0.005 | Good | 7.6 | Good | Excellent | | Example 31 |
| 44 | S | ○ | ○ | ○ | 9.3 | 0.005 | Good | 7.7 | Good | Excellent | | Example 32 |
| 45 | T | ○ | ○ | ○ | 10.1 | 0.005 | Good | 7.6 | Good | Excellent | | Example 33 |

Remarks)
1): Fe content (wt. %) In Hot-Dip galvannealing layer
2): Mo content (wt. %) In Hot-Dip galvannealing layer

TABLE 7

| Experiment No. | Kind of Steel | Galvanizability | Coating Adhesion | Exterior View After Galvannealing | Degree of Galvannealing[1] (wt. %) | Amount Of Mo Diffusion[2] (wt. %) | Workability | Weight Loss By Corrosion ($g/m^2$) | Evaluation Of Corrosion Resistance | Spot Weldability | Division |
|---|---|---|---|---|---|---|---|---|---|---|---|
| 46 | U | ○ | ○ | ○ | 10.6 | 0.005 | Good | 7.4 | Good | Excellent | Example 34 |
| 47 | v | ○ | ○ | ○ | 9.9 | 0.005 | Good | 7.6 | Good | Excellent | Example 35 |
| 48 | W | ○ | ○ | ○ | 10.4 | 0.005 | Good | 7.5 | Good | Excellent | Example 36 |
| 49 | x | ○ | ○ | ○ | 10.3 | 0.005 | Good | 7.6 | Good | Excellent | Example 37 |
| 50 | DD | x | x | x | 8.1 | 0.001 | Good | 16 | Poor | Excellent | Comparative Example 13 |
| 51 | K | x | x | ○ | 9.3 | 0.000 | Poor | 25 | Poor | Excellent | Comparative Example 14 |
| 52 | L | ○ | ○ | ○ | 9.3 | 0.008 | Poor | 7 | Good | Excellent | Comparative Example 15 |
| 53 | M | ○ | ○ | ○ | 9.4 | 0.024 | Poor | 4 | Good | Excellent | Comparative Example 16 |
| 54 | N | ○ | ○ | ○ | 9.7 | 0.011 | Poor | 6 | Good | Poor | Comparative Example 17 |
| 55 | B | x | x | x | 9.5 | 0.020 | Good | 5 | Good | Excellent | Comparative Example 18 |
| 56 | B | x | ○ | ○ | 9.5 | 0.020 | Good | 5 | Good | Excellent | Comparative Example 19 |

TABLE 7-continued

| Experiment No. | Kind of Steel | Galvanizability | Coating Adhesion | Exterior View After Galvannealing | Degree of Galvannealing[1)] (wt. %) | Amount Of Mo Diffusion[2)] (wt. %) | Workability | Weight Loss By Corrosion ($g/m^2$) | Evaluation Of Corrosion Resistance | Spot Weldability | Division |
|---|---|---|---|---|---|---|---|---|---|---|---|
| 57 | B | ○ | x | ○ | 11.9 | 0.025 | Good | 4 | Good | Excellent | Comparative Example 20 |
| 58 | B | ○ | ○ | x | 7.2 | 0.015 | Good | 6 | Good | Excellent | Comparative Example 21 |

Remarks)
[1)]: Fe content (wt. %) In Hot-Dip galvannealing layer
[2)]: Mo content (wt. %) In Hot-Dip galvannealing layer

TABLE 8

| Experiment No. | Kind of Steel | P Content In Steel (wt. %) | Mo Content In Steel (wt. %) | Presence Of Cold Rolling | Heating Temp. In Annealing Furnace (° C.) | Kind Of Acid In Pr-treatment Pickling | Heating-Reduction Temp.[2)]: t1 (° C.) | Heating-Reduction Dew Point[3)] (° C.) | Heating-Reduction $H_2$ Concentration (vol. %) |
|---|---|---|---|---|---|---|---|---|---|
| 59 | A | 0.01 | 0.15 | Present | — | — | 810 | −45 | 5 |
| 60 | K | 0.01 | 0 | Present | — | — | 810 | −45 | 5 |
| 61 | R | 0.04 | 0.05 | Present | — | — | 830 | −40 | 20 |
| 62 | S | 0.07 | 0.05 | Present | — | — | 850 | −35 | 5 |
| 63 | T | 0.07 | 0.05 | Present | — | — | 840 | −40 | 5 |
| 64 | U | 0.07 | 0.05 | Present | — | — | 830 | −40 | 5 |
| 65 | V | 0.07 | 0.05 | Present | — | — | 850 | −35 | 2 |
| 66 | W | 0.07 | 0.05 | Present | — | — | 840 | −40 | 5 |
| 67 | X | 0.09 | 0.05 | Present | — | — | 810 | −45 | 50 |
| 68 | A | 0.01 | 0.15 | Present | — | — | 820 | 0 | 5 |

| Experiment No. | Reducation Or Not Of P-based Oxides | Al Content In Galvanizing Bath (wt. %) | Galvannealing Temp.: t2[4)] (° C.) | α-Value | β-Value | Y-Value | Division |
|---|---|---|---|---|---|---|---|
| 59 | Reduced | 0.15 | 480 | 0.96 | 0.45 | 1.01 | Example 38 |
| 60 | Reduced | 0.15 | 480 | 0.96 | 0.45 | 1.01 | Example 39 |
| 61 | Reduced | 0.15 | 490 | 0.98 | 0.53 | 1.03 | Example 40 |
| 62 | Reduced | 0.15 | 505 | 1.00 | 0.63 | 1.04 | Example 41 |
| 63 | Reduced | 0.15 | 500 | 1.01 | 0.55 | 1.04 | Example 42 |
| 64 | Reduced | 0.15 | 505 | 1.02 | 0.55 | 1.04 | Example 43 |
| 65 | Reduced | 0.15 | 510 | 1.00 | 0.63 | 1.03 | Example 44 |
| 66 | Reduced | 0.15 | 500 | 1.01 | 0.55 | 1.05 | Example 45 |
| 67 | Reduced | 0.15 | 515 | 1.07 | 0.50 | 1.05 | Example 46 |
| 68 | Not Reduced | 0.15 | 480 | 0.95 | —∞ | 1.01 | Comparative Example 22 |

Remarks)
[2)]: Sheet temperature upon heating-reduction prior to Hot-Dip galvanizing;
[3)]: Dew point of atmosphere gas upon heating-reduction prior to Hot-Dip galvanizing;
[4)]: Sheet temperature;
α-Value: {[P (wt. %) + (2/3)] × 1100}/{Heating Temp.: T (° C.)}
β-Value: {[P (wt. %) + (2/3)] × (−30)}/{Dew Point: t (° C.)}
Y-Value: [7 × {100 × [P (wt. %) + (2/3)] + 10 × Al (wt. %)}]/{Galvannealing Temp.: $t_2$ (° C.)}

TABLE 9

| Experiment No. | Kind of Steel | Galvanizability | Coating Adhesion | Exterior View After Galvannealing | Degree of Galvannealing[1)] (wt. %) | Amount Of Mo Diffusion[2)] (wt. %) | Workability | Weight Loss By Corrosion ($g/m^2$) | Evaluation Of Corrosion Resistance | Spot Weldability | Division |
|---|---|---|---|---|---|---|---|---|---|---|---|
| 59 | A | ○ | ○ | ○ | 9.2 | 0.012 | Good | 7 | Good | Excellent | Example 38 |
| 60 | K | ○ | ○ | ○ | 9.5 | 0.000 | Good | 20 | Poor[3)] | Excellent | Example 39 |
| 61 | R | ○ | ○ | ○ | 9.6 | 0.010 | Good | 6 | Good | Excellent | Example 40 |
| 62 | S | ○ | ○ | ○ | 10.1 | 0.012 | Good | 7 | Good | Excellent | Example 41 |
| 63 | T | ○ | ○ | ○ | 10.3 | 0.010 | Good | 6 | Good | Excellent | Example 42 |
| 64 | U | ○ | ○ | ○ | 9.6 | 0.010 | Good | 6 | Good | Excellent | Example 43 |
| 65 | V | ○ | ○ | ○ | 10.1 | 0.012 | Good | 7 | Good | Excellent | Example 44 |
| 66 | W | ○ | ○ | ○ | 10.3 | 0.010 | Good | 6 | Good | Excellent | Example 45 |
| 67 | X | ○ | ○ | ○ | 9.9 | 0.012 | Good | 7 | Good | Excellent | Example 46 |
| 68 | A | x | x | x | 8.4 | 0.010 | Good | 6 | Good | Excellent | Comparative Example 22 |

Remarks)

TABLE 9-continued

| Experiment No. | Kind of Steel | Galvanizability | Coating Adhesion | Exterior View After Galvannealing | Degree of Galvannealing[1)] (wt. %) | Amount Of Mo Diffusion[2)] (wt. %) | Workability | Weight Loss By Corrosion ($g/m^2$) | Evaluation Of Corrosion Resistance | Spot Weldability | Division |
|---|---|---|---|---|---|---|---|---|---|---|---|

[1)]: Fe content (wt. %) In Hot-Dip galvannealing layer
[2)]: Mo content (wt. %) In Hot-Dip galvannealing layer
[3)]: Weight loss by corrosion in Example 39 using a Not-Mo-Added steel was used as reference.

What is claimed is:

1. A manufacturing method of a high strength thin steel sheet excellent in workability and galvanizability, comprising the steps of hot-rolling a slab having a composition comprising:

C: from 0.01 to 0.20 wt. %,

Si: up to 1.0 wt. %,

Mn: from 1.0 to 3.0 wt. %,

P: up to 0.10 wt. %,

S: up to 0.05 wt. %,

Al: up to 0.10 wt. %,

N: up to 0.010 wt. %,

Cr: up to 1.0 wt. %,

Mo: from 0.001 to 1.00 wt. %, and the balance Fe and incidental impurities, coiling the hot-rolled steel sheet at a temperature of up to 750° C., and then, after heating the steel sheet to a temperature of at least 750° C., cooling the same.

2. A manufacturing method of a high strength thin steel sheet excellent in workability and galvanizability, comprising the steps of hot-rolling a slab having a composition comprising:

C: from 0.01 to 0.20 wt. %,

Si: up to 1.0 wt. %,

Mn: from 1.0 to 3.0 wt. %,

P: up to 1.0 wt. %,

S: up to 0.05 wt. %,

Al: up to 0.10 wt. %,

N: up to 0.010 wt. %,

Cr: up to 1.0 wt. %,

Mo: from 0.001 to 1.00 wt. %, and the balance Fe and incidental impurities, coiling the hot-rolled steel sheet at a temperature of up to 750° C., then cold-rolling the steel sheet, and then, after heating to a temperature of at least 750° C., cooling the same.

3. A manufacturing method of a high strength thin steel sheet excellent in workability and galvanizability, according to claim 1, comprising the step of, after heating said steel sheet to a temperature of at least 750° C., applying hot-dip galvanizing in the middle of cooling, or after application of hot-dip galvanizing, subjecting the steel sheet to a galvannealing treatment.

4. A manufacturing method of a high strength thin steel sheet excellent in workability and galvanizability according to claim 1, comprising the steps of, after heating said steel sheet to a temperature of at least 750° C., cooling the same, further, heating the same to a temperature within a range of from 700 to 850° C., and in the middle of subsequent cooling, subjecting said steel sheet to hot-dip galvanizing, or further to a galvannealing treatment after hot-dip galvanizing.

5. A manufacturing method of a high strength thin steel sheet excellent in workability and galvanizability according to claim 1, wherein said slab further contains one or more selected from the groups consisting of up to 1.0 wt. % Nb, up to 1.0 wt. % Ti and up to 1.0 wt. % V.

6. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, further, heating the same to a temperature of at least 750° C. in an annealing furnace, pickling the same after cooling, then, conducting heating-reduction under reducing conditions of P-based oxides remaining as pickling residues on the steel sheet surface and subjecting the steel sheet to hot-dip galvanizing.

7. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then, after cold-rolling the steel sheet, heating the same to a temperature of at least 750° C. in an annealing furnace, cooling the same, pickling the same, and after conducting heating-reduction under reducing conditions of P-based oxides remaining as pickling residues on the steel sheet surface, and subjecting the steel sheet to hot-dip galvanizing.

8. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then heating the steel sheet to a temperature of at least 750° C. in an annealing furnace, cooling the same, pickling the same, then after heating-reducing the steel sheet under conditions including a dew point of an atmosphere gas within a range of from −50° C. to 0° C. and a hydrogen concentration of the atmosphere gas within a range of from 1 to 100 vol. %, subjecting the steel sheet to hot-dip galvanizing.

9. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then cold-rolling the steel sheet, heating the same to a temperature of at least 750° C. in an annealing furnace, then after cooling the same, pickling the steel sheet, heating-reducing the steel sheet under conditions including a dew point of an atmosphere gas within a range of from −50° C. to 0° C. and a hydrogen concentration in the atmosphere gas within a range of from 1 to 100 vol. %, and then, subjecting the steel sheet to hot-dip galvanizing.

10. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then heating the same to a temperature of at least 750° C. in an annealing furnace, cooling the same, pickling the same, then, heating-reducing the steel sheet under a condition that the heating -reduction temperature: $t_1$ (° C.) satisfies the following equation (1) relation to the P content in steel: P(wt. %), and then, subjecting the steel sheet to hot-dip galvanizing:

$$0.9 \leqq \{[P(\text{wt. }\%)+(2/3)]\times 1100\}/\{t_1(^\circ\text{ C.})\} \leqq 1.1 \quad (1)$$

11. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, cold-rolling the same, then heating the steel sheet to a temperature of at least 750° C. in an annealing furnace, cooling the same, pickling the same, then, heating-reducing the steel sheet under a condition that the heating-reduction temperature: $t_1$ (° C.) satisfies the following equation (1) relative to P content in steel: P(wt. %), and then, subjecting the steel sheet to hot-dip galvanizing:

$$0.9 \leqq \{[P(\text{wt. }\%)+(2/3)]\times 1100\}/\{t_1(^\circ\text{ C.})\} \leqq 1.1 \quad (1)$$

12. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then, heating the steel sheet to a temperature of at least 750° C. in an annealing furnace, cooling the same, pickling the same, then, heating-reducing the steel sheet under conditions including a dew point of an atmosphere gas within a range of from −50° C. to 0° C., a hydrogen concentration in the atmosphere gas within a range of from 1 to 100 vol. %, and a heating-reduction temperature: $t_1$ (° C.) satisfying the following equation (1) relative to the P content in steel: P (wt. %), and then, subjecting the steel sheet to hot-dip galvanizing:

$$0.9 \leqq \{[P(\text{wt. }\%)+(2/3)]\times 1100\}/\{t_1(^\circ\text{ C.})\} \leqq 1.1 \quad (1)$$

13. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then, after cold rolling the steel sheet, heating the same to a temperature of at least 750° C. in an annealing furnace, then cooling the same, pickling the same, then heating-reducing the steel sheet under conditions including a dew point of an atmosphere gas within a range of from −50° C. to 0° C., a hydrogen concentration in the atmosphere gas within a range of from 1 to 100 vol. %, and a heating-reduction temperature: $t_1$ (° C.) satisfying the following equation (1) relative to the P content in steel: P (wt. %), and then subjecting the steel sheet to hot-dip galvanizing:

$$0.9 \leqq \{[P(\text{wt. }\%)+(2/3)]\times 1100\}/\{t_1(^\circ\text{ C.})\} \leqq 1.1 \quad (1)$$

14. A manufacturing method of a high strength hot-dip galvanized steel sheet excellent in workability and coating adhesion according to claim 6, wherein the method of pickling applied after heating the steel sheet to a temperature of at least 750° C. in said annealing furnace is a pickling method comprising the step of pickling the steel sheet in a pickling liquid having a pH≦1 and a liquid temperature within a range of from 40 to 90° C. for a period within a range of from 1 to 20 seconds.

15. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then heating the same at a heating temperature: T within a range of from 750° C. to 1,000° C. and satisfying the following equation (2) in an atmosphere gas having a dew point: t of an atmosphere gas satisfying the following equation (3) and a hydrogen concentration within a range of from 1 to 100 vol. %, and then subjecting the steel sheet to hot-dip galvanizing:

$$0.85 \leqq \{[P(\text{wt. }\%)+(2/3)]\times 1150\}/\{T(^\circ\text{ C.})\} \leqq 1.15 \quad (2)$$

$$0.35 \leqq \{[P(\text{wt. }\%)+(2/3)]\times(-30)\}/\{t(^\circ\text{ C.})\} 1.8 \quad (3)$$

16. A manufacturing method of a high strength hot-dip galvanized steel sheet excellent in workability and coating adhesion according to claim 1, comprising the steps of, after coiling the hot-rolled steel sheet at a temperature of up to 750° C., pickling the same, then cold-rolling the same, then heating the same at a heating temperature: T within a range of from 750° C. to 1,000° C. and satisfying the following equation (2) in an atmosphere gas having a dew point: t of an atmosphere gas satisfying the following equation (3) and a hydrogen concentration within a range of from 1 to 100 vol. %, and then subjecting the steel sheet to hot-dip galvanizing:

$$0.85 \leqq \{[P(\text{wt. }\%)+(2/3)]\times 1150\}/\{T(^\circ\text{ C.})\} \leqq 1.15 \quad (2)$$

$$0.35 \leqq \{[P(\text{wt. }\%)+(2/3)]\times(-30)\}/\{t(^\circ\text{ C.})\} \leqq 1.8 \quad (3)$$

17. A manufacturing method of a high strength hot-dip galvanized steel sheet excellent in workability and coating adhesion according to claims 6, wherein said slab further contains one or more selected from the group consisting of up to 1.0 wt. % Nb, up to 1.0 wt. % Ti and up to 1.0 wt. % V.

18. A manufacturing method of a high strength galvannealed steel sheet excellent in workability and coating adhesion, comprising the step of subjecting the hot-dip galvanized steel sheet obtained by the manufacturing method of a high strength hot-dip galvanized steel sheet according to any claim 6, further to a galvannealing treatment.

19. A manufacturing method of a high strength galvannealed steel sheet excellent in workability and coating adhesion, comprising the steps of subjecting the hot-dip galvanized steel sheet according to claim 17 further to a galvannealing treatment, wherein the galvannealing temperature: $t_2$ (° C.) in said galvannealing treatment satisfies the following equation (4) relative to the P content in steel: P (wt. %) and the Al content: Al (wt. %) in the bath upon said hot-dip galvanizing:

$$0.95 \leqq [7\times\{100\times[P(\text{wt. }\%)+(2/3)]+10\times Al(\text{wt. }\%)\}]/[t_2(^\circ\text{ C.})] \leqq 1.05 \quad (4)$$

20. A manufacturing method of a high strength galvannealed steel sheet excellent workability and coating adhesion according to claim 18 wherein said slab further contains one or more selected from the group consisting of up to 1.0 wt. % Nb, up to 1.0 wt. % Ti and up to 1.0 wt. % in V.

21. A high strength galvannealed steel sheet excellent in workability, coating adhesion and corrosion resistance obtained by hot-dip galvanizing a steel sheet containing up to 1.00 wt. % Mo and galvannealing the same, wherein the galvannealing layer has an Fe content within a range of from 8 to 11 wt. % and an Mo content within a range of from 0.002 to 0.11 wt. %.

* * * * *